US009399359B2

(12) United States Patent
Masunaga et al.

(10) Patent No.: US 9,399,359 B2
(45) Date of Patent: Jul. 26, 2016

(54) IMAGE FORMING APPARATUS INCLUDING SWITCHING MEMBER

(71) Applicants: Suguru Masunaga, Kanagawa (JP); Kikuya Nakada, Kanagawa (JP)

(72) Inventors: Suguru Masunaga, Kanagawa (JP); Kikuya Nakada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/926,945

(22) Filed: Oct. 29, 2015

(65) Prior Publication Data

US 2016/0121626 A1 May 5, 2016

(30) Foreign Application Priority Data

Nov. 4, 2014 (JP) ..... 2014-224118
Mar. 19, 2015 (JP) ..... 2015-055931

(51) Int. Cl.
*B41J 11/00* (2006.01)
*G03G 15/00* (2006.01)
*B41J 13/00* (2006.01)

(52) U.S. Cl.
CPC ..... *B41J 11/007* (2013.01); *G03G 15/6529* (2013.01); *B41J 13/009* (2013.01)

(58) Field of Classification Search
CPC ..... B41J 11/007; B41J 13/009; B41J 13/10; B41J 11/38; B41J 33/42; B41J 11/54; G03G 15/6529
USPC ..... 347/104, 101, 16
See application file for complete search history.

(56) References Cited

U.S. PATENT DOCUMENTS

| | | | |
|---|---|---|---|
| 8,425,025 | B2 | 4/2013 | Masunaga |
| 8,596,736 | B2 | 12/2013 | Kobayashi et al. |
| 8,657,395 | B2 | 2/2014 | Masunaga et al. |
| 8,827,395 | B2 | 9/2014 | Masunaga |
| 8,857,932 | B2 | 10/2014 | Kobayashi et al. |
| 8,870,317 | B2 | 10/2014 | Kobayashi et al. |
| 8,894,169 | B2 | 11/2014 | Masunaga et al. |
| 8,926,076 | B2 | 1/2015 | Kobayashi et al. |
| 8,926,202 | B2 | 1/2015 | Nakada |

(Continued)

FOREIGN PATENT DOCUMENTS

| | | |
|---|---|---|
| JP | H05-085647 | 4/1993 |
| JP | 2011-194680 | 10/2011 |

OTHER PUBLICATIONS

U.S. Appl. No. 14/482,079, filed Sep. 10, 2014.

(Continued)

*Primary Examiner* — Henok Legesse
(74) *Attorney, Agent, or Firm* — Cooper & Dunham LLP

(57) ABSTRACT

An image forming apparatus includes a paper feeding unit; an image formation unit; a conveyance unit configured to clamp and convey a recording medium; a paper ejection unit; a manual paper feeding unit configured to receive another recording medium inserted manually and feed the other recording medium from the paper ejection unit; and a switching member fixed on an axle and configured to move between a retracted position, which is retracted from a conveyance path in a case where the image formation unit forms an image, and an abutting position entering the conveyance path by rotating with a rotation of the axle. In a case of feeding the other recording medium manually inserted, the switching member is arranged at the abutting position, clamping by the conveyance unit is released, the other recording medium arrives at an abutment position, and the conveyance unit clamps the other recording medium.

15 Claims, 18 Drawing Sheets

(56) References Cited

U.S. PATENT DOCUMENTS

| | | | | |
|---|---|---|---|---|
| 9,004,390 | B2 | 4/2015 | Morinaga et al. | |
| 2005/0243153 | A1* | 11/2005 | Takahashi | 347/101 |
| 2007/0057429 | A1* | 3/2007 | Watanabe et al. | 271/9.01 |
| 2013/0106967 | A1* | 5/2013 | Yamamoto | 347/104 |
| 2014/0028751 | A1* | 1/2014 | Nishimura | 347/16 |
| 2014/0167580 | A1* | 6/2014 | Funayama et al. | 312/237 |

OTHER PUBLICATIONS

U.S. Appl. No. 14/462,719, filed Aug. 19, 2014.
U.S. Appl. No. 14/640,804, filed Mar. 6, 2015.

* cited by examiner

IMAGE FORMING APPARATUS INCLUDING SWITCHING MEMBER

BACKGROUND OF THE INVENTION

1. Field of the Invention

The disclosures herein generally relate to an image forming apparatus, and in particular relate to an image forming apparatus provided with, in addition to a paper feeding unit for a recording medium (e.g. a roll paper), a manual paper feeding unit for another kind of recording medium (e.g. a cut paper).

2. Description of the Related Art

Conventionally, image forming apparatuses, each provided with a conveyance path and a paper feeding roller only for a cut paper, which is manually fed, separately from a paper feeding unit for a roll paper, have already been known. Moreover, image forming apparatuses, each manually feeding a paper by making a cut paper butt directly against a nip of a conveyance roller common to the printing on a roll paper, are also known. Moreover, a method of releasing a nip of a conveyance roller from a side of a paper discharge port upon printing on a roll paper, inserting manually a cut paper to a back end of paper (a leading end upon inserting), and nipping again with the conveyance roller is also known.

However, a paper which is manually fed is not necessarily a new paper, and has a wrinkle or a bend in the leading end in some cases. Moreover, there is a case of cutting a roll paper to use (a cut paper), or a case of printing on a backing paper of a cut paper. In the above-described cases, there is a problem that upon transporting a paper through a nip portion of the conveyance roller by the conventional automatic paper feeding, an edge fold occurs in a leading end of paper, or a skew or a jam occurs.

Moreover, a height of a scanner-integrated image forming apparatus which can be provided with plural roll papers is restricted due to operability of a scanner unit. Moreover, there is also demand for feeding a thick paper manually. However, in an image forming apparatus, of which front access is required, it is difficult to arrange a tray only for manual paper feeding on a machine front side. This is because a thick paper may become creased upon being turned.

Moreover, in the method of releasing a nip of a conveyance roller from a side of a paper discharge port, inserting manually a cut paper to a back end of paper (a leading end upon inserting), and nipping again, in a case of a long paper, it is troublesome to pass the paper into a conveyance path manually. Furthermore, there is a problem that depending on a curling direction of a paper, the paper may enter a conveyance path for a roll paper, and since an alignment of paper is performed by sight, a skew may occur.

Japanese Published Patent Application No. H5-85647 discloses inserting a manual feeding sheet between a conveyance guide and a manual feeding roller so that a failure of sheet feeding will not occur. However, since it is necessary to press the manual feeding roller by a cut paper upon inserting, a leading end of sheet could be held in a state of being deflected, creased or wrinkled. Moreover, in a case of a sheet of low stiffness, it may not be inserted properly and may be jammed.

SUMMARY OF THE INVENTION

It is a general object of at least one embodiment of the present invention to provide an image forming apparatus that substantially obviates one or more problems caused by the limitations and disadvantages of the related art.

In one embodiment, an image forming apparatus includes a paper feeding unit configured to store and feed a recording medium; an image formation unit configured to form an image on the recording medium; a conveyance unit configured to clamp and convey the recording medium fed from the paper feeding unit along a conveyance path to the image formation unit; a driving source configured to supply a driving force to the conveyance unit; a paper ejection unit configured to eject the recording medium; a manual paper feeding unit configured to receive another recording medium inserted manually and feed the other recording medium from the paper ejection unit; and a switching member having a claw and fixed on an axle and configured to move between a retracted position retracted from the conveyance path and an abutting position entering the conveyance path by rotating with a rotation of the axle. In a case of feeding the other recording medium manually inserted, the switching member is arranged at the abutting position, clamping of the recording medium by the conveyance unit is released, the other recording medium fed by the manual paper feeding unit from the paper ejection unit arrives at an abutment position where a leading end of the other recording medium abuts the switching member, and the conveyance unit clamps the other recording medium. The switching member is arranged at the retracted position in a case where the image formation unit forms an image on the recording medium or the other recording medium.

According to the embodiment of the present invention, there is provided an image forming apparatus, in which a nip of a conveyance means is released, different recording media are manually fed to a switching member held at an abutting position from a paper discharging unit (manual paper feeding unit) side and clipped. Then, a user's operation is minimized, and any kind of recording medium can be manually fed without a skew or a jam, and without occupying a great space for the apparatus. Moreover, a long recording medium can be manually fed easily.

BRIEF DESCRIPTION OF THE DRAWINGS

Other objects and further features of embodiments will become apparent from the following detailed description when read in conjunction with the accompanying drawings in which.

DESCRIPTION OF THE PREFERRED EMBODIMENTS

In the following, embodiments of the present invention will be described with reference to the accompanying drawings.

Figure 1:
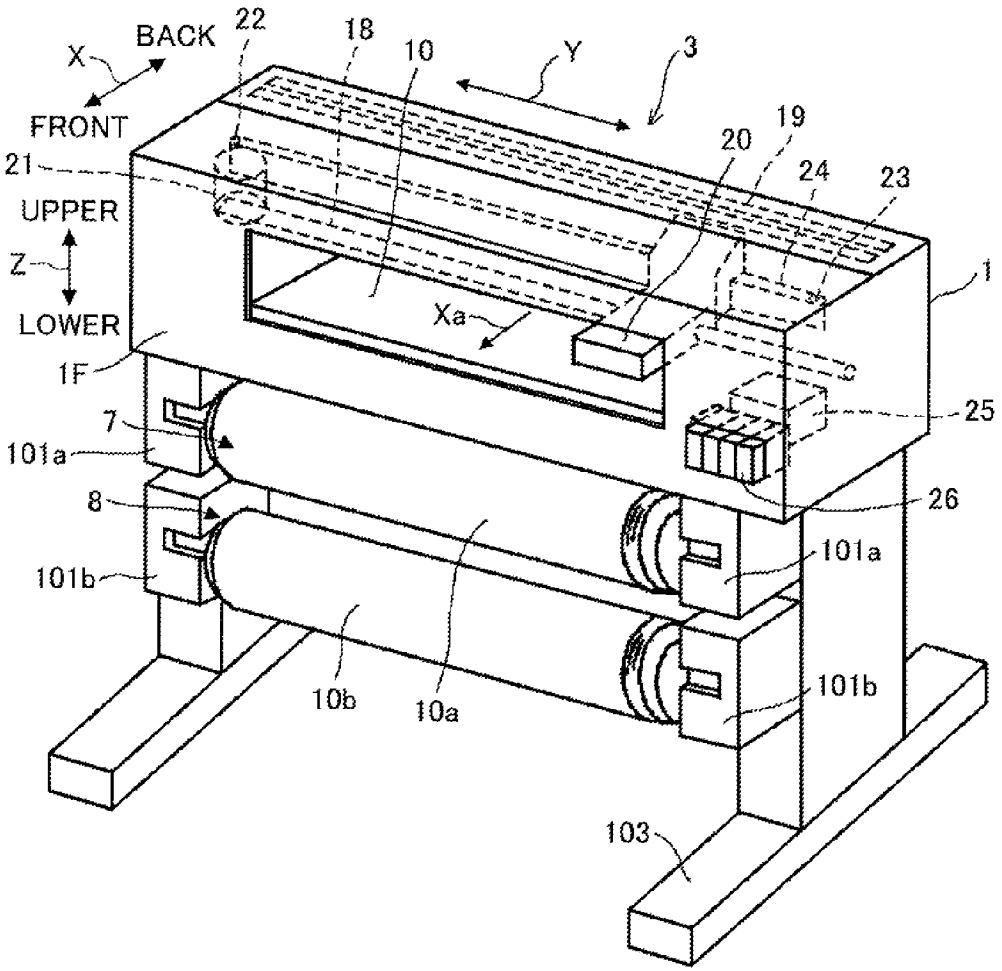
FIG. 1 is a perspective view schematically illustrating an example of a configuration of an image forming apparatus according to a present embodiment.

FIG. 1 is a perspective view schematically illustrating an example of an image forming apparatus 1 according to a present embodiment. The image forming apparatus 1 is a recording apparatus for an ink jet recording system, and is an ink jet printer that performs printing on a recording medium by discharging ink droplets corresponding to image data. However, the image forming apparatus 1 may be an electrophotographic copier, an electrophotographic printer or the like which conveys a recording medium and performs printing.

In FIG. 1, "X" represents a depth direction (front-back direction) of the image forming apparatus 1, "Y" represents a width direction (main scanning direction) of the image forming apparatus 1, and "Z" represents a vertical direction.

An image formation unit 3 arranged in an upper part of the image forming apparatus 1 has a configuration for performing image formation for an ink jet recording system. The image forming apparatus 1 according to the present embodiment is a serial type ink jet recording system. In the image formation unit 3, a guide rod 18 and a guide rail 19 bridge in the main scanning direction "Y" between side plates which are not shown, and on the guide rod 18 and the guide rail 19 a carriage 20 is held movably in the main scanning direction "Y".

On the carriage 20, liquid recording heads for discharging ink droplets of respective colors of black (K), yellow (Y), magenta (M) and cyan (C) is mounted. In each of the liquid recording heads, a sub tank for supplying ink is arranged in an integrated manner.

A main scanning mechanism that moves and causes the carriage 20 to scan in the main scanning direction "Y" includes a driving motor 21 arranged on one side in the main scanning direction "Y" (left obliquely upward direction), a driving pulley 22 connected to an output axle of the driving motor 21 and rotationally driving, a driven pulley 23 arranged on another side in the main scanning direction "Y" (right obliquely downward direction), and a belt member 24 wound between the driving pulley 22 and the driven pulley 23.

To the driven pulley 23, tension is applied by a tension spring outwardly, i.e. in a direction of separating from the driving pulley 22.

A part of the belt member 24 is fixed and held at a belt fixture part arranged on a back side of the carriage 20, and the belt member 24 pulls the carriage 20 in the main scanning direction "Y" by receiving power from the driving pulley 22 and rotating.

An encoder is arranged along the main scanning direction "Y" of the carriage 20, an encoder sensor provided on the carriage 20 reads out an encoder sheet, and thereby a position of the carriage 20 in the main scanning direction is detected.

Moreover, by a reflection type sensor installed on the carriage 20, both ends of a paper 10 set in a lower part of the image forming apparatus 1 are detected, and on this occasion a size of the paper 10 is detected from the position in the main scanning direction read out by the encoder sensor.

Figure 2:
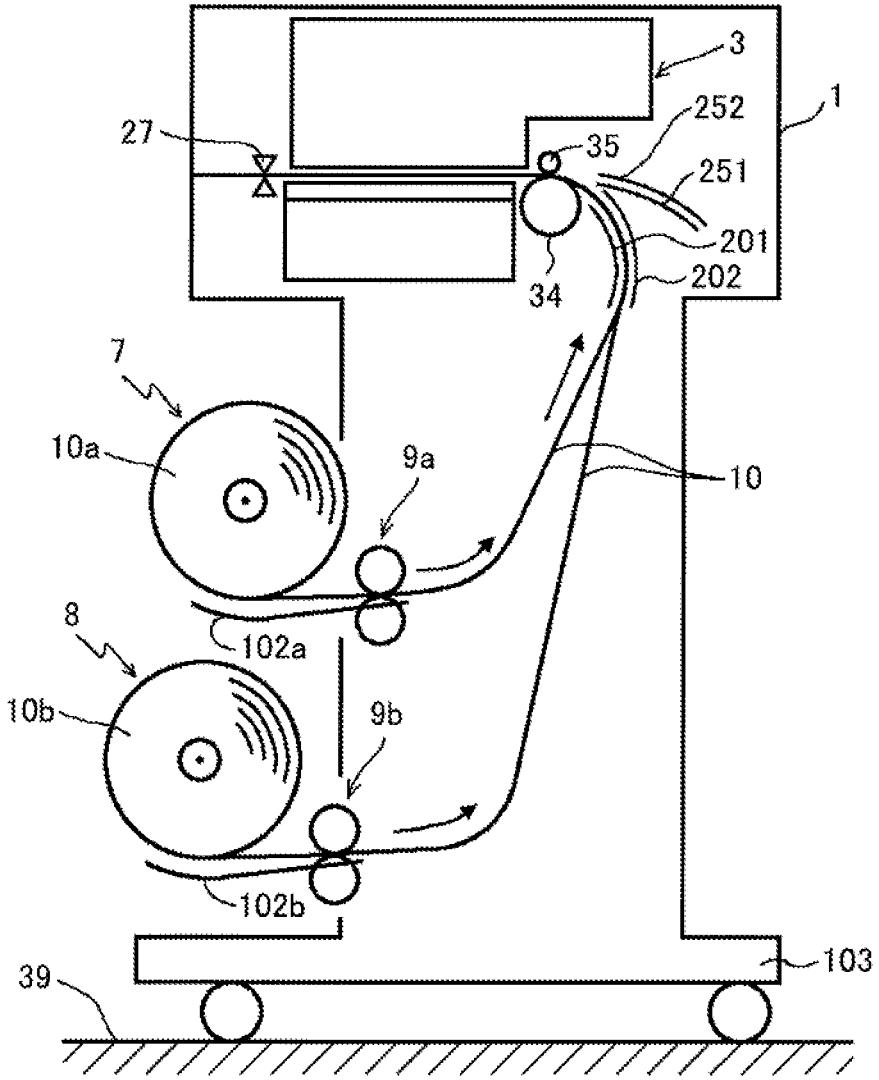
FIG. 2 is a side view schematically illustrating an example of the image forming apparatus according to the present embodiment.

As shown in FIGS. 1 and 2, the image forming apparatus 1 has a stand 103, a paper feeding unit is provided below the image formation unit 3, and in the paper feeding unit an upper stage roll paper 10*a* and a lower stage roll paper 10*b* are included. The stand 103 is placed on a floor face 39. A front face 1F of the image forming apparatus 1 includes plural apertures 7, 8 (two in the present embodiment) corresponding to spool bearing stands 101*a*, 101*b*. The roll papers 10*a*, 10*b* can be set from a side of the front face 1F in the spool bearing stands 101*a*, 101*b* via the apertures 7, 8. As shown in FIG. 2, a paper 10 is delivered from the upper stage roll paper 10*a* or the lower stage roll paper 10*b* and conveyed. Then, the paper is clamped and conveyed by a conveyance roller 34 which is a conveyance means provided in an upper part of the apparatus main body and a pressure roller 35.

Figure 3:
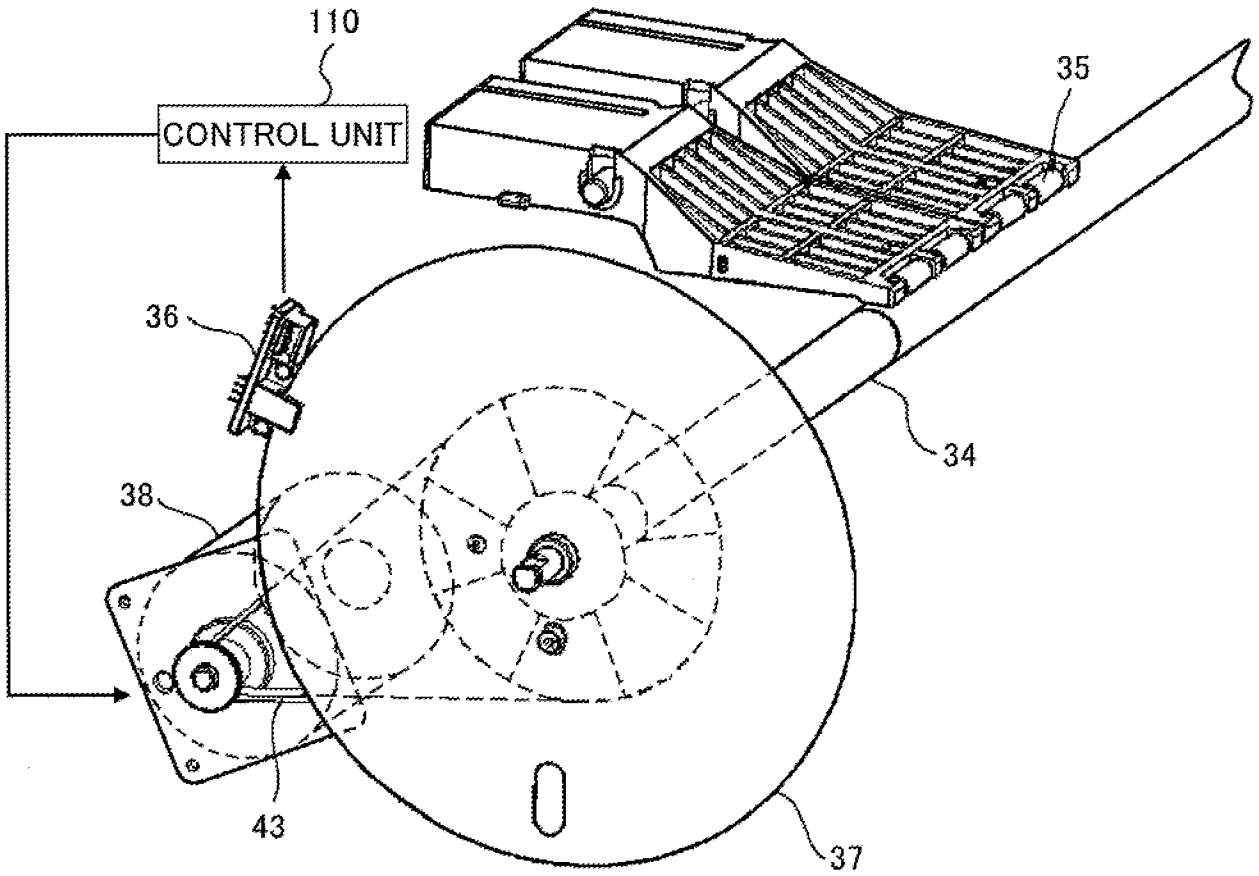
FIG. 3 is a diagram schematically illustrating an example of a configuration around a conveyance roller according to the present embodiment.

In a recording region of a main scanning region of the carriage 20, the paper 10 is intermittently conveyed by a recording medium conveyance device, shown in FIG. 3, in a sub scanning direction (front direction "Xa" in the front-back direction "X" in FIG. 1) perpendicular to the main scanning direction "Y" which is a moving direction of the carriage 20. At this time, as shown in FIG. 3, an encoder 37 provided coaxially with the conveyance roller 34 is read out by a encoder sensor 36 provided on the side plate which is not shown. An amount of conveyance of the paper 10 is controlled by a control unit 110 electrically connected to the encoder sensor 36 based on the information read out in this way. In the example of FIG. 3, the encoder 37 is configured as a rotary encoder, in which an optical grid is arranged on a circular plate, and an angle, an amount of rotation, a rotational speed and the like can be detected.

Moreover, in one end part side region (right obliquely downward direction, in FIG. 1) in the main scanning direction of the carriage 20, a maintenance and restoration mechanism 25 for performing maintenance and restoration for the respective liquid recording heads in the carriage 20 is arranged. Furthermore, on the front face of the apparatus main body, a main cartridge 26 containing ink of the respective colors to be supplied to the sub tanks of the respective liquid recording heads is mounted attachably and detachably.

Spool axles of the upper stage roll paper 10*a* and the lower stage roll paper 10*b* are supported rotatably by the bearing stands 101*a* and 101*b*, respectively. As shown in FIGS. 2 and 3, the paper is clamped and conveyed by conveyance roller pairs 9*a*, 9*b*, the conveyance roller 34 and the pressure roller 35. The conveyance roller pairs 9*a*, 9*b* are arranged adjacent to the upper stage roll paper 10*a* and the lower stage roll paper 10*b*, and below their shaft centers, respectively. The conveyance roller 34 and the pressure roller 35 are positioned on downstream sides of the conveyance rollers pairs 9A, 9B in a recording medium conveyance direction, but above the upper stage roll paper 10*a* and the lower stage roll paper 10*b*. Roll paper guide parts 102*a*, 102*b* are adjacent to the near side along central axles of rotation of the upper stage roll paper 10*a* and the lower stage roll paper 10*b* which are placed and set on the spool bearing stands 101*a*, 101*b*, and function as guides upon feeding paper from the respective roll papers.

The paper 10 is transported through a predetermined conveyance path formed by guide members 201, 202 and the like, and arrives at the image formation unit 3. Then, the liquid recording head discharges liquid drops of the respective colors on the paper 10 corresponding to image data, and thereby an image is formed.

A paper ejection unit that eject a paper 10 on which the image is formed, is provided with a cutter 27 for cutting the paper 10 to a predetermined length. The cutter 27 is fixed to a wire or a timing belt which is wound between plural pulleys, one of which is linked to the driving motor 21. The cutter 27 is moved in the main scanning direction "Y" by power from the driving motor 21, and thereby cuts the paper 10 to a predetermined length. The cut paper 10 is ejected to the paper ejection unit and stacked.

Next, the characteristic part of the present invention will be explained.

Figure 4:
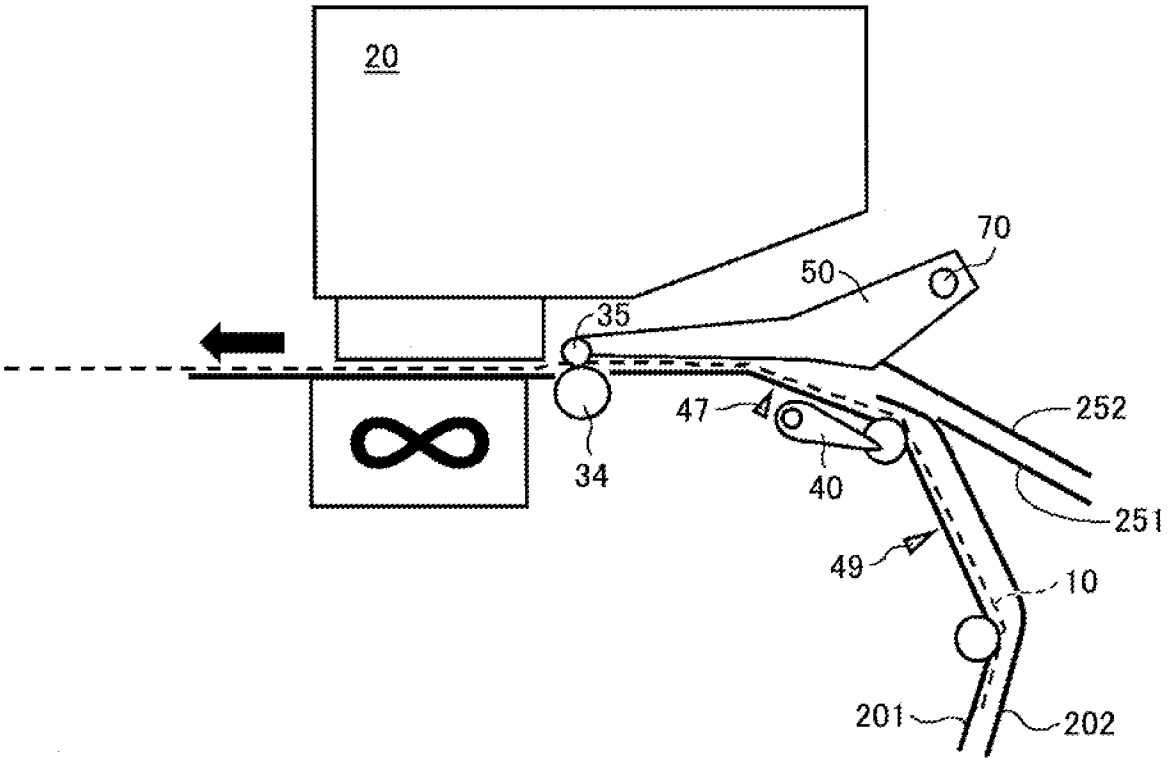
FIG. 4 is a side view schematically illustrating an example of a configuration around a carriage 20, and schematically illustrating an example of a status of a paper 10 fed out from an upper roll paper 10*a* or from a lower roll paper 10*b* and conveyed according to the present embodiment.

FIG. 4 is a side view schematically illustrating a vicinity of the carriage 20, and shows a status of the paper 10 which is a recording medium taken from the upper roll paper 10*a* or from the lower roll paper 10*b* and conveyed. Along the paper conveyance path formed by the guide members 201, 202 and the like, in the paper conveyance direction, a pre-resist sensor 49, a switching member 40, a pressure arm 50, a manual feeding sensor 47, the conveyance roller 34, the pressure roller 35 and the like are arranged. The pressure arm 50 arranged above the paper conveyance path can rotate around an axle 70, and is provided with the pressure roller 35 at an end portion on an opposite side of the axle 70. In a case where the pressure arm 50 rotates in a counter-clockwise direction, the pressure roller 35 comes in contact with the conveyance roller 34, and the pressure roller 35 is separated from the conveyance roller by a rotation of the pressure arm 50 in the clockwise direction. The switching member 40 has plural claw members (switching claws) arranged for an axle 41 (see FIG. 8) at intervals, and can rotate with a rotation of the axle 41. In the drawings, the paper 10 is expressed by a broken line, transported through the paper conveyance path formed by the guide members 201, 202 and the like, clamped by the conveyance roller 34 and the pressure roller 35, and printed while being conveyed in the direction of an arrow in FIG. 4. At this time, since the switching member 40 is at a retracted position which is retracted from the paper conveyance path, it does not affect the paper conveyance.

Next, a procedure of operating on a paper upon manually feeding the paper will be explained with reference to FIGS. 5 and 6.

Figure 5:
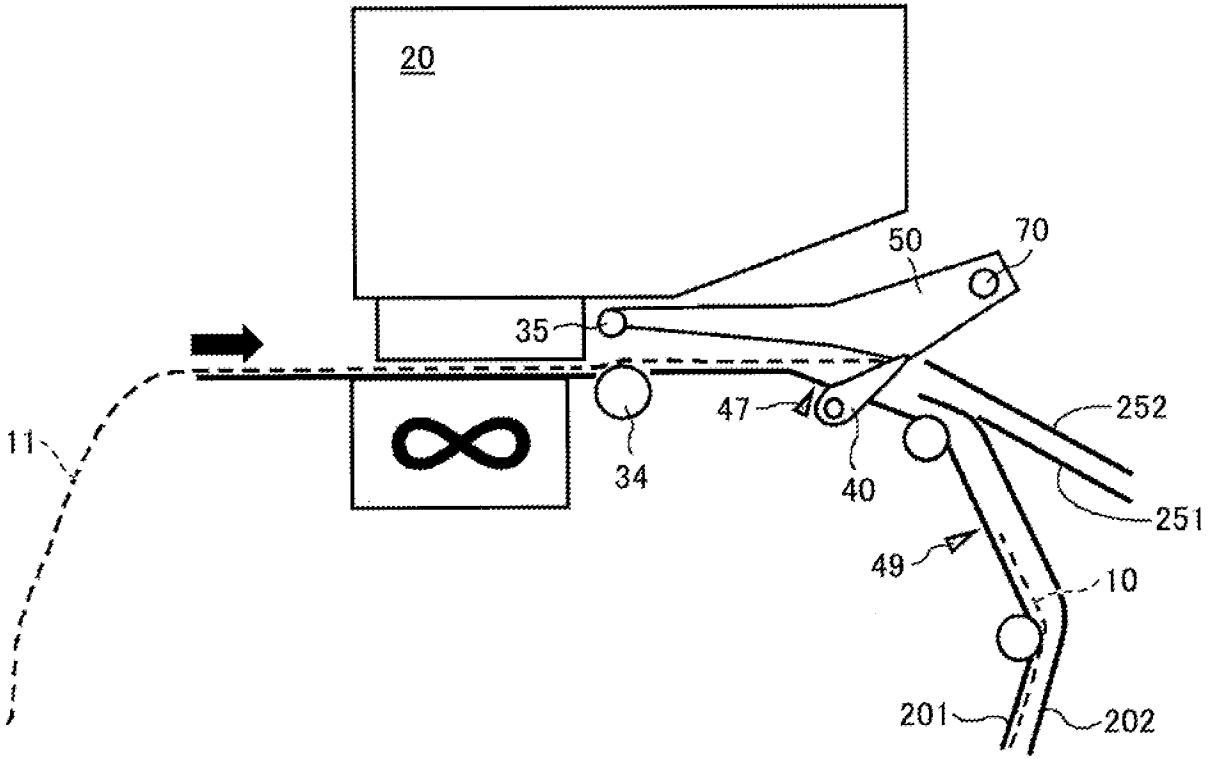
FIG. 5 is a diagram schematically illustrating an example of an operation procedure for a paper upon manually feeding paper according to the present embodiment.

As shown in FIG. 5, a manual paper feeding unit is provided, which can manually feed a cut paper 11 as a different recording medium from a side of the paper ejection unit. Since it is necessary to first reverse the paper 10 before manually feeding a cut paper 11 from the paper ejection unit (e.g. a user manually inserts the cut paper 11 into the paper ejection unit), the paper 10 is retracted to the pre-resist sensor 49 by reversely rotating the conveyance roller 34 and rewinding the paper 10. Thereafter, the pressure roller 35 is decompressed by a rotation of the pressure arm 50, the clamping with the conveyance roller 34 is released, and a cut paper 11 to be printed is manually fed from the paper ejection port side until the end. At this time, the switching member 40 is held at an abutting position, which enters the paper conveyance path, and causes the cut paper 11 to abut and sets the cut paper 11 without bending. The manual feeding sensor 47 detects that the cut paper 11 abuts the switching member 40. Then, the cut paper 11 is pressed and clamped by the pressure roller 35 and the conveyance roller 34. The cut paper 11 is preferably suctioned and held by a platen so as not to deviate. Moreover, the paper conveyance path is preferably configured to be narrow so that edges of the abutted paper are aligned. The plural switching members 40 are arranged in a width direction of the paper (vertical direction in the drawing) so as to get into gaps of the pressure arm 50. For this reason, the guide members 201, 202 include incisions for the switching member 40 entering.

Figure 6:
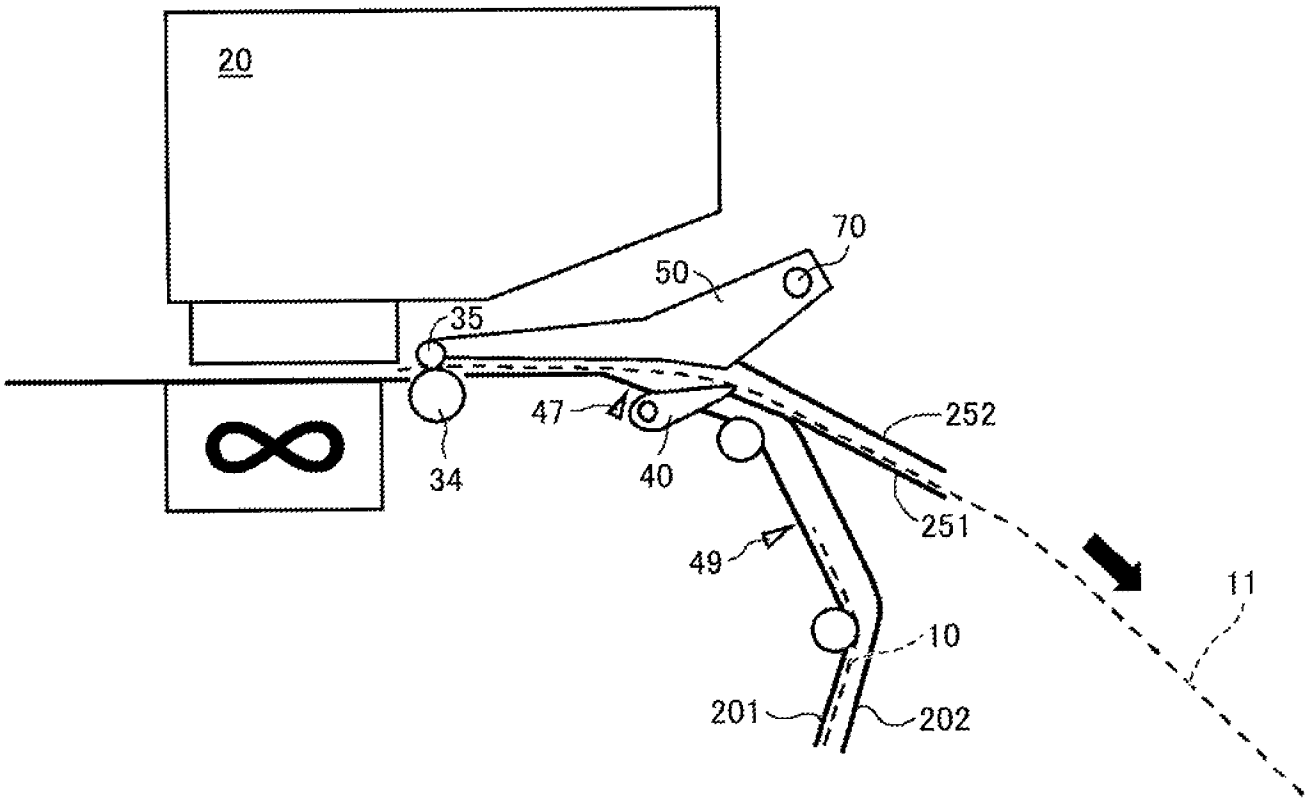
FIG. 6 is a diagram schematically illustrating another example of the operation procedure for a paper upon manually feeding paper according to the present embodiment.

Next, as shown in FIG. 6, after the pressing/clamping by the pressure roller 35 and the conveyance roller 34, the conveyance roller 34 is inverted, and the cut paper 11 is guided/conveyed in the paper feeding path and set at a print start position. At the print start position, an edge of paper is positioned in front of the carriage 20. At this time, the switching member 40 is arranged at a switching position for guiding the cut paper 11 into a manual feeding conveyance path so that the cut paper 11 does not enter a conveyance path for roll papers formed by the guide members 201, 202. The switching position is at a rotational position between the retracted position (FIG. 4) and the abutting position (FIG. 5). At the switching position, the switching member 40 covers the conveyance path for roll papers. Therefore, the cut paper 11 enters the conveyance path for the cut paper 11 (manual feeding conveyance path) formed by the guide members 251, 252. At this time, after the edge of paper enters the manual feeding conveyance path, the switching member 40 may be rotated to the retracted position. In a case where a clutch 42 (see FIG. 8) is turned ON while inverting the conveyance roller 34, the switching member 40 becomes at the retracted position.

Figure 7:
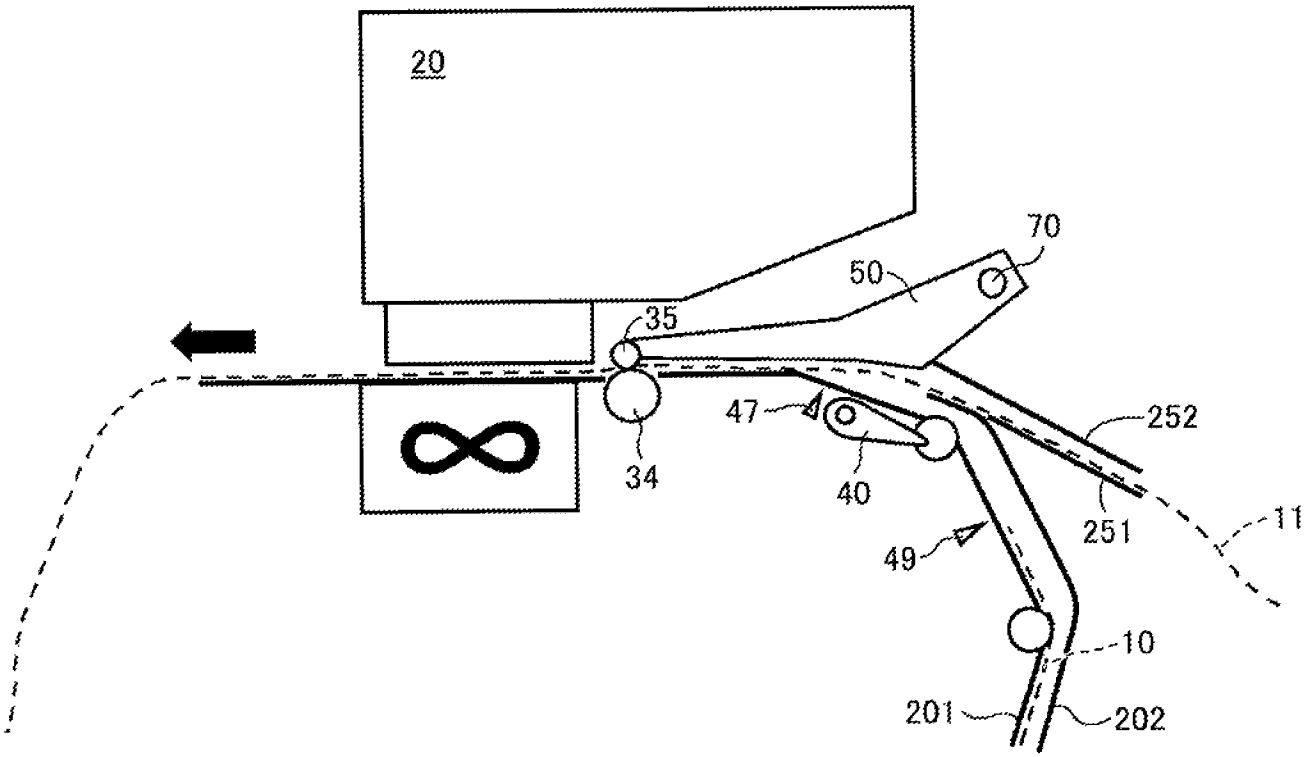
FIG. 7 is a diagram schematically illustrating an example of a status upon printing after the manual paper feeding according to the present embodiment.

FIG. 7 shows a status upon printing after the manual paper feeding.

By normally rotating the conveyance roller 34 after the manual paper feeding, the cut paper 11 is conveyed in a direction of an arrow, and is printed by the carriage 20. Since the switching member 40 is held at the retracted position upon printing on the cut paper 11, it does not negatively affect the printing. Moreover, as shown in FIG. 4, the switching member 40 is held at the retracted position also upon the printing on the paper 10.

Figure 8:
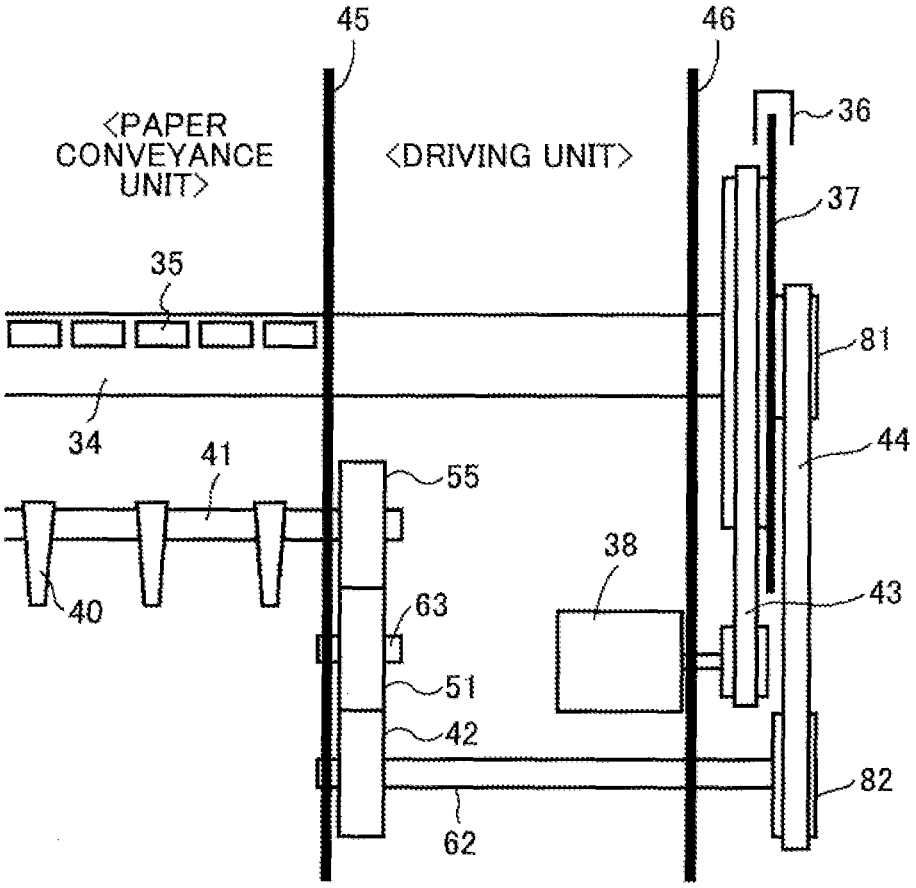
FIG. 8 is a plan view schematically illustrating an example of a paper conveyance unit and a driving unit according to the present embodiment.

Next, a configuration of the paper conveyance unit and the driving unit will be explained with reference to FIG. 8. FIG. 8 is a plan view schematically illustrating the paper conveyance unit and the driving unit.

The paper conveyance unit resides inside an inner side plate 45 and the driving unit is outside the inner side plate 45.

The conveyance roller 34 is linked to a motor 38 as a driving source via a timing belt 43, and thereby obtains a driving force. The motor 38 is arranged inside an outer side plate 46, and its output axle is positioned outside the outer side plate 46. The timing belt 43 is wound at a pulley which is fixed at the output axle of the motor 38 and a pulley which is fixed coaxially with the conveyance roller 34. There is the pressure roller 35 above the conveyance roller 34. As shown also in FIG. 3, the encoder 37 is attached coaxially with the conveyance roller 34, and around the encoder 37 the encoder sensor 36 for reading it is arranged. Information on the encoder 37 read out by the encoder sensor 36 is sent to the control unit 110, and a precise amount of rotation of the conveyance roller 34 can be obtained by the control unit 110.

On the other hand, by the axle 41 rotating, the position of the switching member 40 can be switched. The axle 41 is linked to the conveyance roller 34 via the timing belt 44, the clutch 42, a torque limiter 51, a gear 55 or the like. The timing belt 44 is wound at a pulley 81, which is fixed coaxially with the conveyance roller 34, and a pulley 82 fixed at one end of an axle 62. Moreover, at another end of the axle 62, the clutch 42 is provided. The clutch is, for example, an electromagnetic clutch, and linked to the torque limiter 51 which is fixed at an axle 63. The torque limiter 51 is linked to the gear 55 which is fixed at the axle 41. Therefore, by engaging the clutch 42 as necessary, the axle 41 can acquire a driving force from the motor 38. Since a rotation of the conveyance roller 34 can be precisely controlled by using the encoder 37, a rotational position of the switching member 40 linked to the side of the conveyance roller 34 via the clutch 42 also can be controlled precisely, without a dedicated motor or a sensor, and a low-cost apparatus can be realized.

Moreover, since a target position, such as the abutting position, the switching position, and the retracted position of the switching member 40, are required to be retained even when the clutch is released, a rotational load, for example, such as the torque limiter 51, as a rotating means capable of normally and reversely rotating is required to be provided. Then, the torque limiter 51 is arranged on the axle 63 which is fixed to the inner side plate 45 and does not rotate. According to the above-described configuration, the axle 63 and the torque limiter 51 do not slide unless a great load is applied. Then, the respective positions of the switching member 40 arranged coaxially with the gear 55 which is linked to the torque limiter 51 are retained even when the clutch 42 is disengaged. Meanwhile, a torque for the torque limiter 51 only has to be set to a degree bearing the abutting by a paper. Moreover, a load may be applied to a gear 55 by a spring or the like as a sliding rotation means, instead of the torque limiter 51 (for example, see FIG. 11).

Since it is not necessary to move the switching member 40 from the retracted position upon normally conveying paper, the clutch is disengaged. In a case of rotating the conveyance roller 34 in this state, only the pulley 82 and the axle 62 rotate via the timing belt 44, and a driving force is not transmitted to the torque limiter 51. On the other hand, in order to move the switching member 40, the clutch 42 only has to be engaged. In a case of rotating the conveyance roller 34 in this state, the pulley 82, the axle 62 and the clutch 34 rotate via the timing belt 44. Therefore, the torque limiter 51 and the gear 55 linked to the clutch 44 also rotate, and thereby the switching member 40 rotates.

Figure 9A:
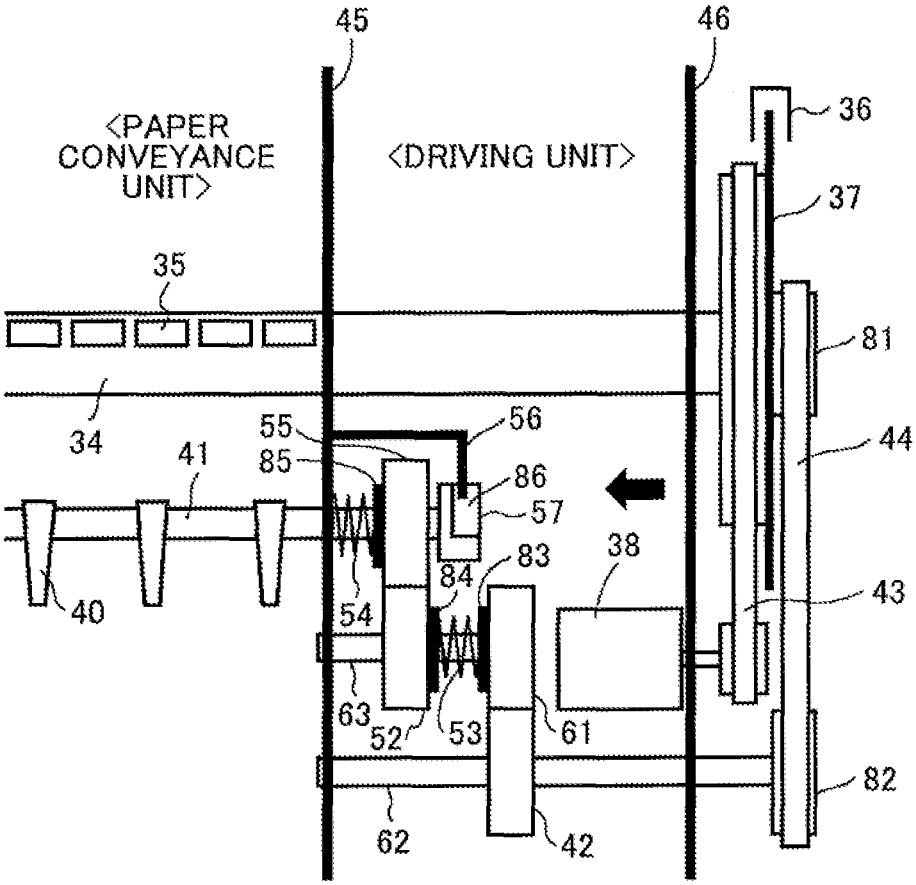
FIGS. 9A to 9C are diagrams schematically illustrating an example of a different paper conveyance unit and a driving unit according to the present embodiment.
Figure 9B:
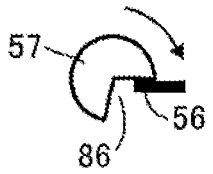
Figure 9C:
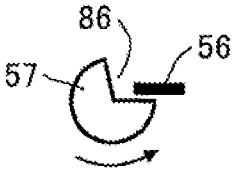

Next, another embodiment of a driving unit will be explained with reference to FIGS. 9A to 9C. FIG. 9A is a plan view schematically illustrating a paper conveyance unit and the driving unit. FIG. 9B is a diagram schematically illustrating a second rotation restricting member 57 and a first rotation restricting member 56 at the abutting position viewed from a direction of the arrow in FIG. 9A. FIG. 9C is a diagram schematically illustrating the second rotation restricting member 57 and the first rotation restricting member 56 at the retracted position.

Configurations of a conveyance roller 34, a pressure roller 35, a switching member 40, an axle 41 in the paper conveyance unit, and configurations of a motor 38, an encoder sensor 36, an encoder 37, timing belts 43, 44, and the like are also the same as those in FIG. 8.

The driving unit according to the present embodiment includes the motor 38, the encoder sensor 36, the encoder 37, the timing belts 43, 44, a clutch 42, a gear 52, springs 53, 54, a gear 55, the first rotation restricting member 56, the second rotation restricting member 57, and circular plate members 83, 84. The axle 41 is linked to the conveyance roller 34 via the timing belt 44, the clutch 42, a gear 61, the gears 52, 55, the spring 53, the circular plate members 83, 84 and the like.

To the clutch 42 arranged on an axle 62, the gear 61 which is fixed at an apical portion of an axle 63 and rotates with the axle 63 is linked. Between the gear 61 and an inner side plate 45, the gear 52 is arranged rotatably with respect to the axle 63. The gear 52 is configured so as not to move toward the inner side plate 45 in the axial direction. The spring 53 is arranged between the gear 52 and the gear 61 on the axle 63, and covers the axle 63. At corresponding end portions of the spring 53, the circular plate members 83 and 84 are positioned for generating friction against the gears 61 and 52, respectively. A material of the circular plate members 83 and 84 is, for example, cork. The gear 52, the spring 53 and the circular plate members 61 and 62 form a slip rotation means in which, in a case where an excessive load is applied, a slip occurs and transmission of torque to the axle 41 is automatically blocked. Since the circular plate members 83 and 84 are butted against the gears 61 and 52 by pressing force of the spring 53, respectively, when the gear 61 rotates, the circular plate members 83, 84 also rotate, and the gear 52 co-rotates. Since the gear 52 is not fixed to the axle 63 and co-rotates by a torque generated by the spring 53 and the circular plate members 83, 84, in a case where the torque becomes greater beyond necessity, the gear 52 and the circular plate member 84 slip. Then, after the first rotation restricting member 56 and the second rotation restricting member 57, which will be described later, abut, the gear 61 and the circular plate member 83 or the gear 52 and the circular plate member 84 slip. Therefore, by the gear 52, the spring 53 or the like, which is a slip rotation means, the same function as a torque limiter is achieved.

Moreover, the gear 55 fixed on the axle 41 is linked to the gear 52. Therefore, in a case where a driving force acquired on the side of the conveyance roller 34 is passed by the clutch 42, and transmitted to the gear 55 via the gear 52, which has the same function as a torque limiter capable of normally and reversely rotating, and the spring 53, the switching member 40 rotates.

Here, the second rotation restricting member 57, which is a circular plate member having a notch 86 in a part in a circumferential direction, is fixed at an apical portion of the axle 41. Moreover, one end of the first rotation restricting member 56 is fixed to the inner side plate 45, and the other end projects in the notch 86. The first rotation restricting member 56 is a fixture member which is fixed to the inner side plate 45. In a case where the second rotation restricting member 57 rotates as the axle 41 rotates, the first rotation restricting member 56 abuts the second rotation restricting member 57. In a case where the second rotation restricting member 57 rotates normally and abuts the first rotation restricting member 56, as shown in FIG. 9B, the switching member 40 is positioned at the abutting position. In a case where the second rotation restricting member 57 rotates inversely and abuts the first rotation restricting member 56, as shown in FIG. 9C, the switching member 40 is positioned at the retracted position. Therefore, in a case where the conveyance roller 34 rotates normally, the switching member 40 rotates toward the abutting position. In a case where the conveyance roller 34 rotates inversely, the switching member 40 rotates toward the retracted position. Since after the abutting, a slip occurs by the slip rotation means, in a case of excessively rotating the conveyance roller 34, parts will not be broken. Since the abutting position or the retracted position as an initial position can be found, the switching position which is between the abutting position and the retracted position can be controlled precisely by the encoder 37 of the conveyance roller 34.

Meanwhile, since the gear 52 is arranged between the clutch 42 and the gear 55, a rotation direction of the conveyance roller 34 coincides with a rotation direction of the axle 41. Then, in a case where the conveyance roller 34 rotates normally, the switching member 40 rotates toward the abutting position (FIG. 9B). In a case where the switching member 40 is at the abutting position, when the conveyance roller 34 rotates inversely, the switching member 40 rotates toward the switching position, at first, and then rotates toward the retracted position (FIG. 9C).

Moreover, the spring 54 is arranged between the gear 55 fixed on the axle 41 and the inner side plate 45, and a circular plate member 85 for generating friction is provided between the spring 54 and the gear 55. A material of the circular plate member 85 is, for example, cork. Then, by the spring 54 and the circular plate member 85, the gear 55 places a rotational load on the inner side plate 45. According to the above-described configuration, in a case where the clutch 42 is disengaged, it is possible to retain the position of the switching member 40.

In order to retain the position of the switching member 40, instead of the configuration shown in FIG. 9A, a gear of a torque limiter which engages the gear 55 may be provided on a new stub axle fixed to the inner side plate 45 while omitting the spring 54 and the circular plate member 85. This torque limiter applies a rotational load to the gear 55.

Figure 10A:
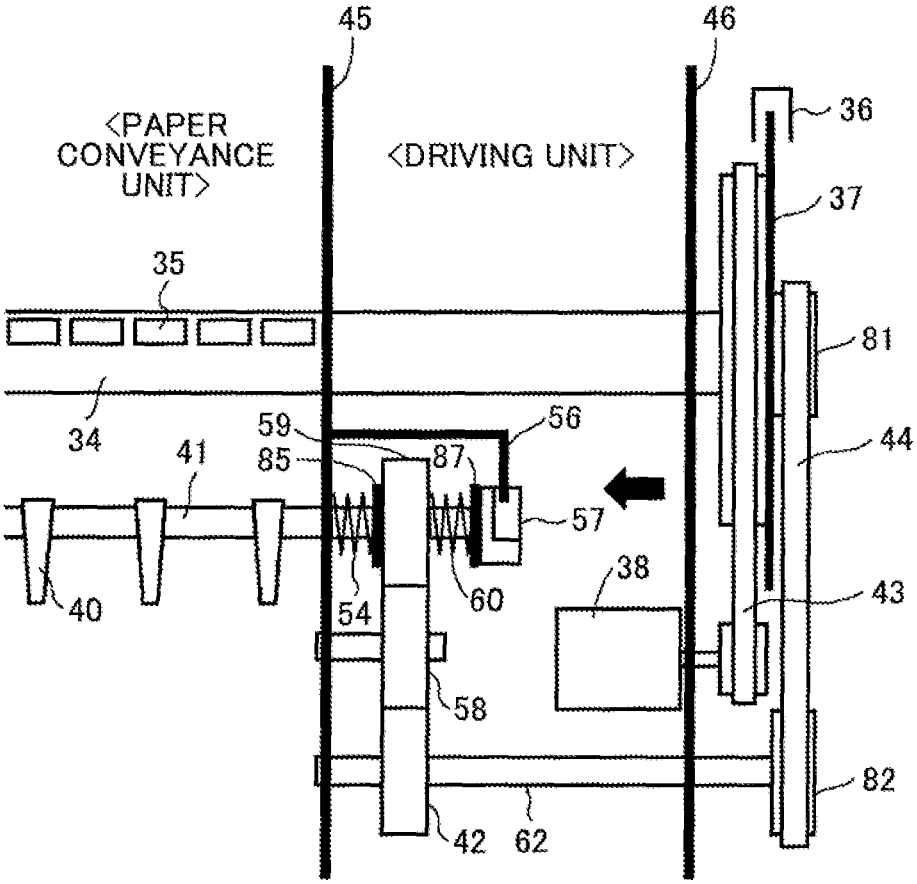
FIGS. 10A to 10C are diagrams schematically illustrating another example of the different paper conveyance unit and the driving unit according to the present embodiment.
Figure 10B:
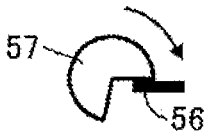
Figure 10C:
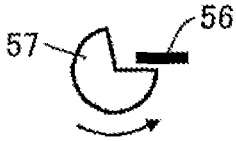

Next, yet another embodiment of a driving unit will be explained with reference to FIGS. 10A to 10C. FIG. 10A is a plan view schematically illustrating a paper conveyance unit and the driving unit. FIG. 10B is a diagram schematically illustrating a second rotation restricting member 57 and a first rotation restricting member 56 at the abutting position viewed from a direction of an arrow in FIG. 10A. FIG. 10C is a diagram schematically illustrating the second rotation restricting member 57 and the first rotation restricting member 56 at the retracted position.

In the following, mainly a part different from the previous embodiments will be explained. The driving unit according to the present embodiment includes a motor 38, an encoder sensor 36, an encoder 37, timing belts 43, 44, a clutch 42, an idler gear 58, a gear 59, springs 54, 60, the first rotation restricting member 56, the second rotation restricting member 57 and circular plate members 85, 87. An axle 41 is linked to a conveyance roller 34 via the timing belt 44, the clutch 42, the idler gear 58, the gear 55 and the like.

According to the present embodiment, the same function as that of the driving unit shown in FIGS. 9A to 9C can be realized with a simpler configuration. That is, a driving force acquired on the side of the conveyance roller 34 is passed by the clutch 42, transmitted to the gear 59 via the idler gear 58, and thereby the switching member 40 rotates. In a case where, as the axle 41 rotates, the second rotation restricting member 57 fixed to the axle 41 and the first rotation restricting member 56 fixed to an inner side plate 45 abut, the switching member 40 occupies the abutting position (FIG. 10B) and the retracted position (FIG. 10C). According to the above-described configuration, in a case where the conveyance roller 34 rotates normally, the switching member 40 rotates toward the abutting position. In a case where the conveyance roller 34 rotates inversely, the switching member 40 rotates toward the retracted position.

The gear 59 is not fixed to the axle 41, and the circular plate member 87 for generating friction and the spring 60 are arranged between the gear 59 and the second rotation restricting member 57. The gear 59, the spring 60 and the circular plate member 87 form a slip rotation means in which, in a case where an excessive load is applied, a slip occurs and transmission of torque to the axle 41 is automatically blocked. Therefore, since for the gear 59, a load is applied to the second rotation restricting member 57 by the circular plate member 87 and the spring 60, when a torque greater than or equal to a predetermined value acts on the gear 59, the circular plate member 87 and the second rotation restricting member 57 slip, so that even in a case of excessively rotating the conveyance roller 34, parts will not be broken. Since the abutting position or the retracted position as an initial position can be found, the switching position which is between the abutting position and the retracted position can be controlled precisely by the encoder 37 of the conveyance roller 34.

Moreover, the spring 54 is arranged between the gear 59 and the inner side plate 45 so that the gear 59 fixed on the axle 41 places a rotational load on the inner side plate 45, and the circular plate member 85 for generating friction is provided between the spring 54 and the gear 59. A material of the circular plate members 85, 87 is, for example, cork. Then, by the spring 54 and the circular plate member 85, the gear 55 transfers a rotational load to the inner side plate 45. According to the above-described configuration, in a case where the clutch 42 is disengaged, it is possible to retain the position of the switching member 40.

Figure 11:
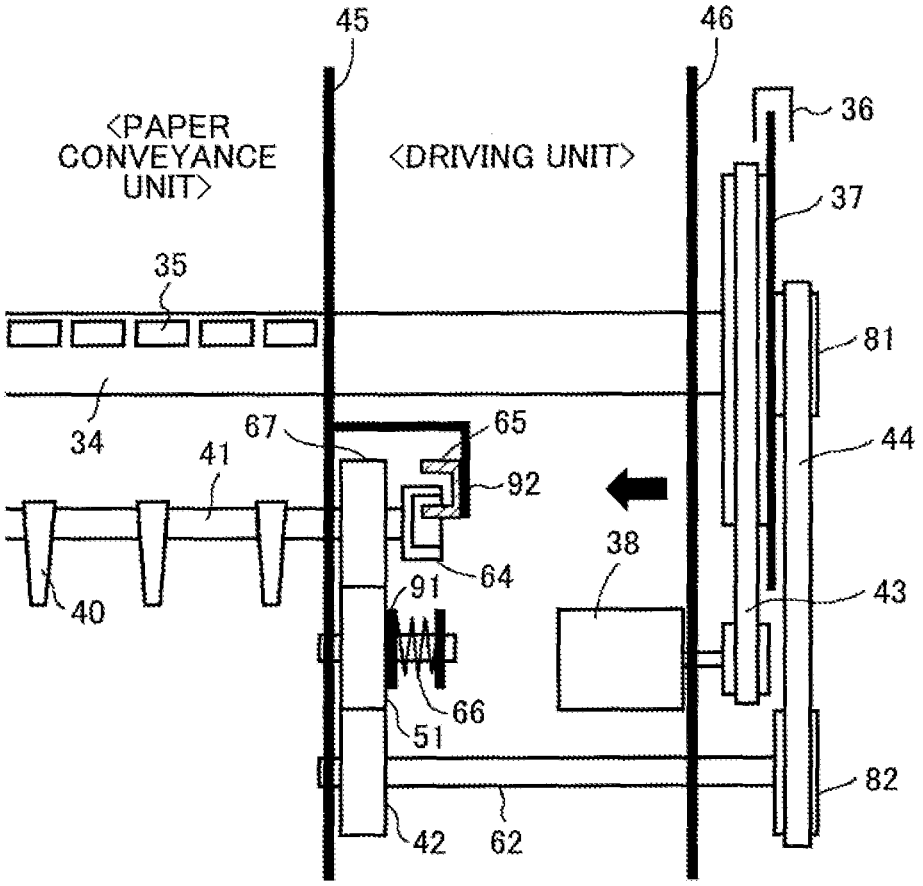
FIG. 11 is a plan view schematically illustrating yet another example of the different paper conveyance unit and the driving unit according to the present embodiment.

Next, still another embodiment of a driving unit will be explained with reference to FIG. 11.

In the following, mainly a part different from the previous embodiments will be explained. The driving unit according to the present embodiment includes a motor 38, an encoder sensor 36, an encoder 37, timing belts 43, 44, a clutch 42, a gear 51, a gear 67, a spring 66, a circular plate member 91, a filler 64, a transmission type photo sensor 65 for detecting the filler 64 and the like. The transmission type photo sensor 65 is fixed to a fixture member 92 fixed to an inner side plate 45. An axle 41 is linked to the conveyance roller 34 via the timing belt 44, the clutch 42, the gear 51 and the gear 67.

In a case where a driving force acquired on the side of the conveyance roller 34 is passed by the clutch 42, and transmitted to the gear 67 via the gear 51, the switching member 40 rotates. By the filler 64 fixed to the axle 41 and the transmission type photo sensor 65 for detecting the filler 64 as a sensor, any one of the abutting position, the switching position and the retracted position of the switching member 40 is detected as an initial position. The switching member 40 may be rotated from the initial position. Other positions can be controlled by the encoder 37 of the conveyance roller 34. In this way, in a case of performing an initial operation using method of detecting the filler 64, rotation restricting members become unnecessary. Moreover, it is advantageous since the present position of the switching member 40 can be obtained. Moreover, since in a case where a manual paper feeding is not performed often, the switching member 40 is positioned mainly at the retracted position, so that it is not necessary to check an initial position upon turning on the image forming apparatus if the retracted position of the switching member 40 is detected. Moreover, the filler 64 and the transmission type photo sensor 65 may be used in combination with the rotation restricting members.

Moreover, the spring 66 for urging the gear 51 in the axial direction and the circular plate member 91 for generating friction against the gear 51 are arranged so that the gear 51 has a rotational load. Accordingly, even in the case where the clutch 42 is disengaged, it is possible to retain respective positions of the switching member 40.

Figure 12A:
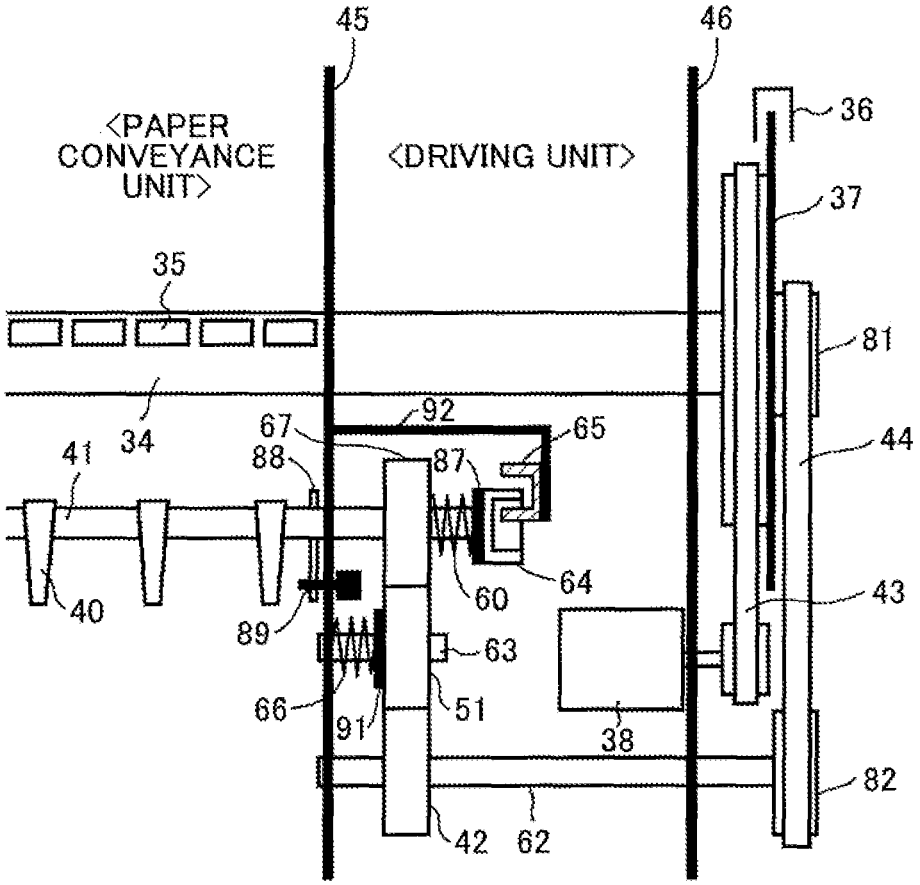
FIGS. 12A to 12C are diagrams schematically illustrating still another example of the different paper conveyance unit and the driving unit according to the present embodiment.

Next, yet another embodiment of a driving unit will be explained with reference to FIG. 12.

In the following, mainly a part different from the previous embodiments will be explained. The driving unit according to the present embodiment includes a motor 38, an encoder sensor 36, an encoder 37, timing belts 43, 44, a clutch 42, a gear 51, a gear 67, springs 66, 60, circular plate members 91, 87, a filler 64, a transmission type photo sensor 65 for detecting the filler and the like. The transmission type photo sensor 65 is fixed to a fixture member 92 fixed to an inner side plate 45. An axle 41 is linked to the conveyance roller 34 via the timing belt 44, the clutch 42, the gear 51 and the gear 67. In a case of engaging the clutch 42 and driving the conveyance roller 34, the axle 41 rotates via the timing belt 44, the clutch 42, the gear 51 and the gear 67, and thereby a position of the switching member 40 changes. Here, a rotation direction of the conveyance roller 34 coincides with a rotation direction of the axle 41.

Moreover, different from the previous embodiments, a paper conveyance unit further includes a spring pin 88 and screws 89, 90.

More specifically, the spring 66 is arranged between the inner side plate 45 and the gear 51, the circular plate member 91 is arranged between the spring 66 and the gear 51, and a load is applied to the gear 51. Accordingly, even in the case where the clutch 42 is disengaged, it is possible to retain respective positions of the switching member 40.

Moreover, the gear 67 is arranged rotatably with respect to the axle 41, and the circular plate member 87 for generating friction against the spring 60 is arranged between the gear 67 and the filler 64. The gear 67, the spring 60 and the circular plate member 87 form a slip rotation means in which, in a case where an excessive load is applied, a slip occurs and transmission of torque to the axle 41 is automatically blocked. Therefore, since for the gear 67 a load is applied to the filler 64 by the circular plate member 87 and the spring 60, when a torque greater than or equal to a predetermined value acts on the gear 67, the circular plate member 87 and the filler 64 slip, so that even in a case of excessively rotating the conveyance roller 34, parts will not be broken. Since a number of revolutions of the conveyance roller 34 can be acquired precisely by the encoder sensor 36, the rotational angle of the switching member 40 can be controlled.

Figure 12B:
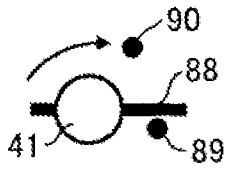
Figure 12C:
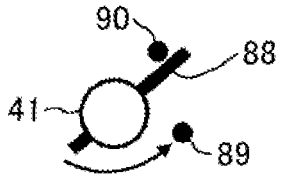

Moreover, the screws 89, 90 as second rotation restricting members are fixed to the inner side plate 45 and project perpendicular to the inner side plate 45 toward the paper conveyance unit. The spring pin 88 as a first rotation restricting member is fixed at a right angle to the axle 41 and extends between the two screws 89, 90. As shown in FIG. 12B, in a case where the conveyance roller 34 rotates normally and the axle 41 rotates in the direction of the arrow in the drawing, the spring pin 88 abuts the screw 89, and the rotation is restricted. Then, the switching member 40 is positioned at the abutting position. As shown in FIG. 12C, in a case where the switching member 40 is at the abutting position, when the conveyance roller 34 rotates inversely and the axle 41 rotates in the direction of an arrow in the drawing, the spring pin 88 abuts the screw 90, and the rotation is restricted. Then, the switching member 40 is positioned at the retracted position. In a case where after the abutting, a driving force is transmitted to the gear 67, an excessive load is applied, and the circular plate member 87 and the filler 64 slip. By the filler 64 fixed to the axle 41 and the transmission type photo sensor 65 for detecting the filler as a sensor, the abutting position, the switching position and the retracted position of the switching member 40 are detected.

Figure 13A:
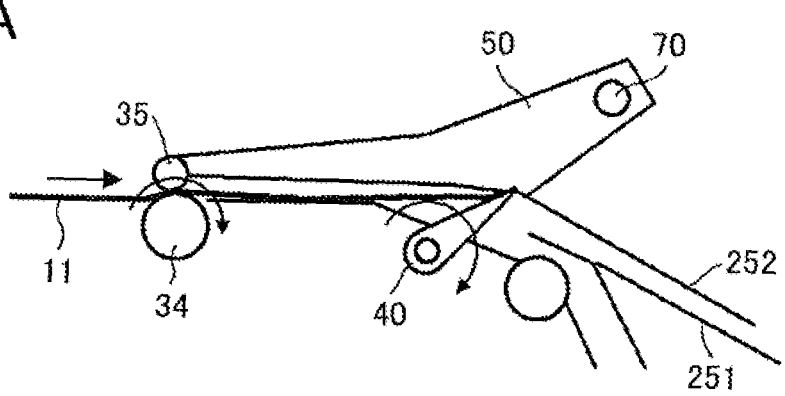
FIGS. 13A to 13C are side views schematically illustrating an example of a status of a cut paper 11 and a switching member 40 upon manually feeding paper according to the present embodiment.
Figure 13B:
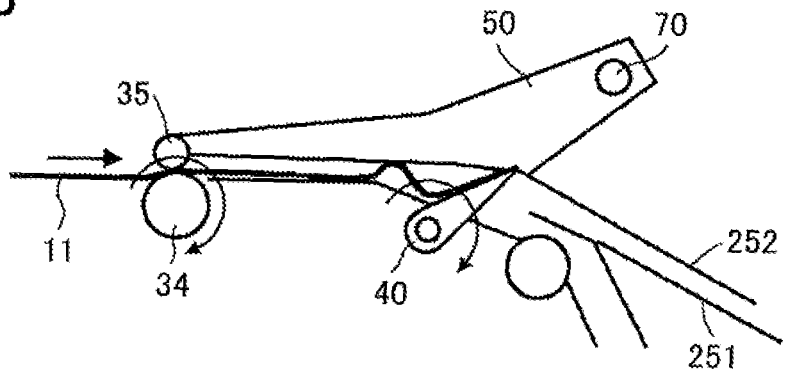
Figure 13C:
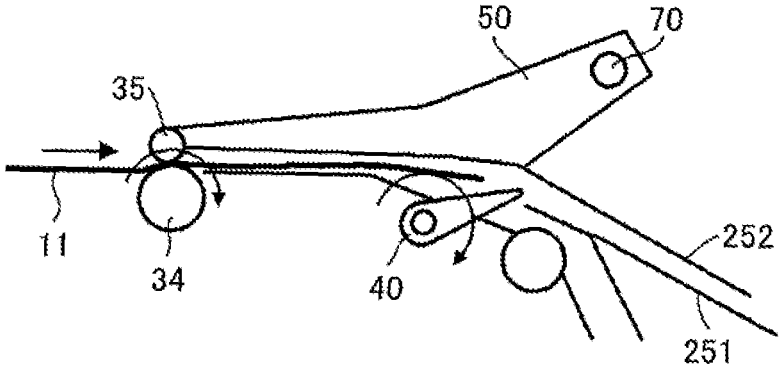

FIGS. 13A to 13C are side views schematically illustrating a status of a cut paper 11 and the switching member 40 upon manually feeding paper.

In FIG. 13A, the switching member 40 is at the abutting position which enters the paper conveyance path, and the cut paper 11 abuts the switching member 40. In a case of rotating the conveyance roller 34 inversely while engaging the clutch 42, the switching member 40 rotates clockwise simultaneously with the conveyance of the cut paper 11, and changes the position. That is, in a case of rotating inversely the conveyance roller 34 in order to guide the cut paper 11 to the manual feeding conveyance path, the switching member 40 is switched to the abutting position, the switching position and the retracted position, in this order. Since in a case of moving the switching member 40 from the abutting position to the switching position, the cut paper 11 is also conveyed, when a rotational speed of the switching member 40 is low whereas a conveyance speed of paper is great, the cut paper 11 abuts the switching member 40, as shown in FIG. 13B, so that the cut paper 11 may be damaged or bent. Therefore, by setting a gear ratio so that the rotational speed of the switching member 40 at the abutting position is greater (the conveyance speed is higher) than the conveyance speed of paper by the conveyance roller 34, as shown in FIG. 13C, it is possible to prevent the cut paper 11 from being pressed against the switching member 40.

Figure 14A:
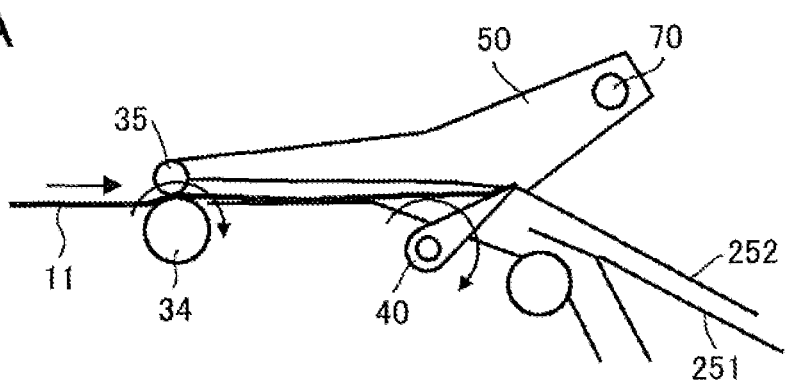
FIGS. 14A to 14C are side views schematically illustrating another example of the status of the cut paper 11 and the switching member 40 upon manually feeding paper according to the present embodiment.
Figure 14B:
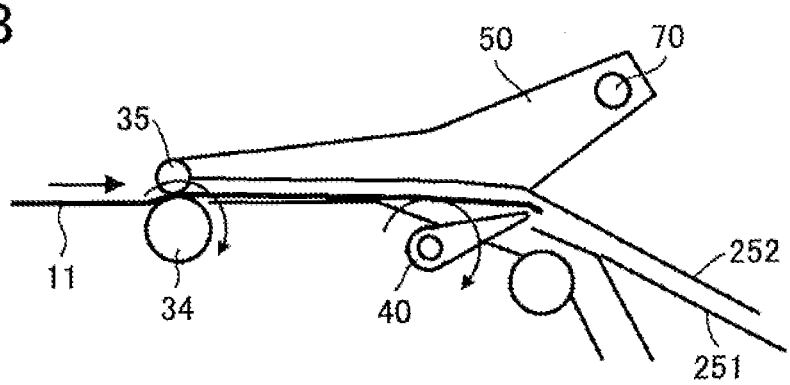
Figure 14C:
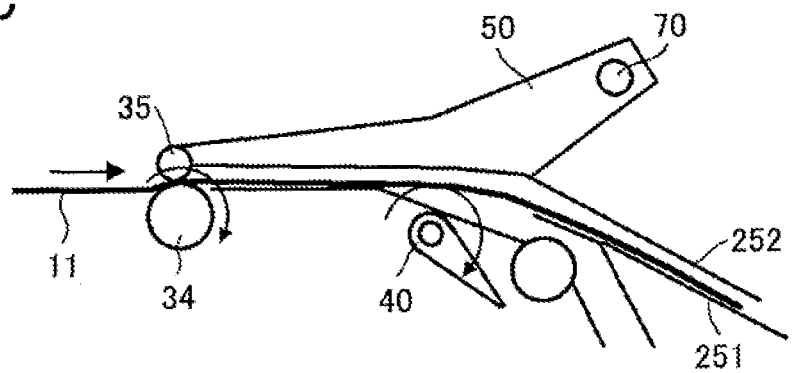

FIGS. 14A to 14C are side views schematically illustrating another example of the status of the cut paper 11 and the switching member 40 upon manually feeding paper.

In FIG. 14A, the switching member 40 is at the abutting position which enters the paper conveyance path, and the cut paper 11 abuts the switching member 40. In a case of rotating the conveyance roller 34 inversely while engaging the clutch 42, the switching member 40 rotates clockwise simultaneously with the conveyance of the cut paper 11, and changes the position. Therefore, as shown in FIG. 14B, the switching member 40 moves to the switching position for guiding the cut paper 11 to the manual feeding conveyance path. Here, as can be seen from FIG. 14B, while the switching member is 40 moving from the abutting position to the switching position, a leading end of the cut paper 11 (back end upon printing) enters the manual feeding conveyance path. Then, a circumferential velocity of the switching member 40 at the abutting position is preferably greater than the conveyance speed of paper of the conveyance roller 34.

Conventionally, in a case of switching the position of the switching member 40 to the abutting position, the switching position or the retracted position, it is necessary to control a conveyance amount of paper and the switching position based on an encoder pulse of the conveyance roller 34, and to switch between ON and OFF for the clutch 42. Since taking account of a delay in engagement of the clutch and a slip upon engaging, the conveyance roller 34 is first stopped and the clutch 42 is engaged, which takes a lot of time.

However, according to the present embodiment, in a case of rotating the switching member 40 from the abutting position to the retracted position at the constant speed while maintaining the clutch 42 engaged, before the switching member 40 moves from the abutting position to the switching position, a leading end of the cut paper 11 enters the manual feeding conveyance path (see FIG. 14B). Therefore, the switching member 40 only has to be simply rotated without recognizing or managing the switching position, and moved directly to the retracted position shown in FIG. 14C. The above-described control is easy and required time can be shortened. Afterwards, the cut paper 11 is conveyed to a position shown in FIG. 6, and the printing starts.

Figure 15A:
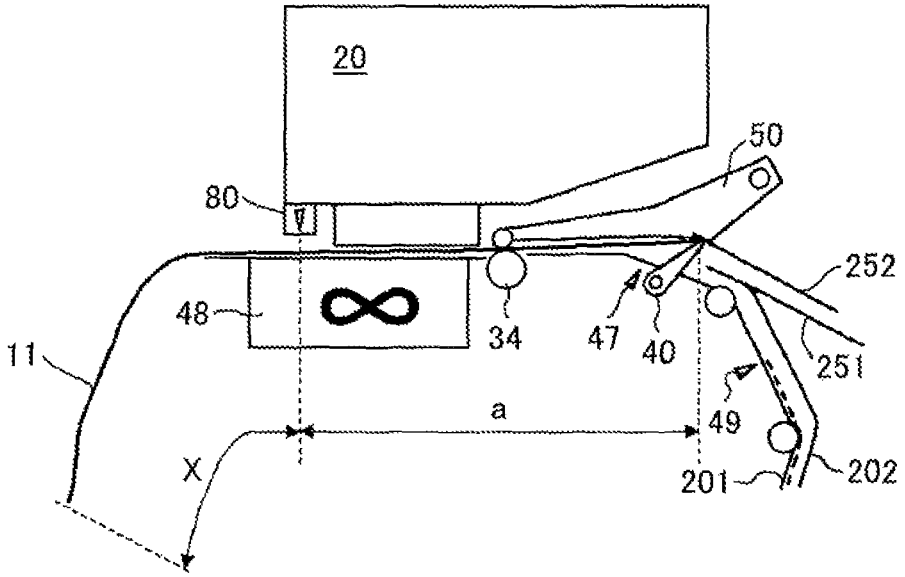
FIGS. 15A and 15B are side views schematically illustrating another example of the configuration around the carriage 20 according to the present embodiment.
Figure 15B:
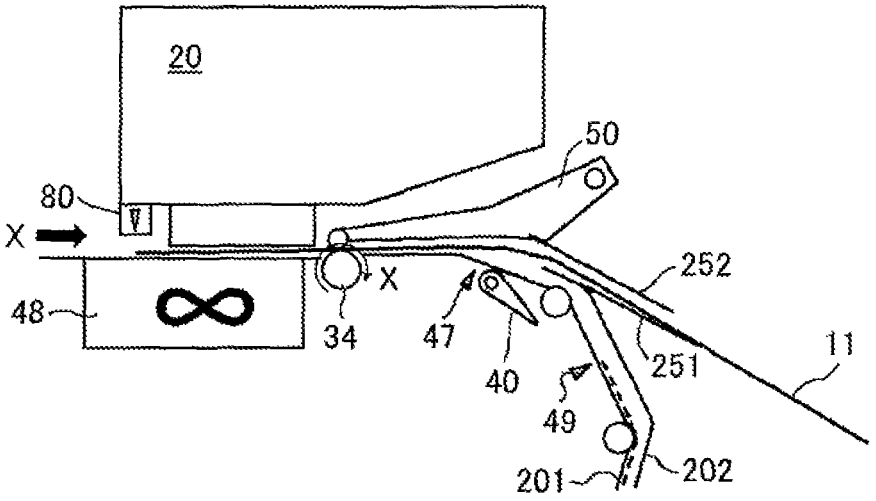

FIGS. 15A and 15B are side views schematically illustrating another example of the configuration around the carriage 20.

In the present embodiment, in the carriage 20 an edge sensor 80 as a photo sensor is installed near the liquid recording head. The edge sensor 80 detects a back end of paper (leading end upon printing) while conveying the cut paper 11 from the abutting position to the print start position, and automatically detects a length of paper. At first, as shown in FIG. 15A, the cut paper 11 is inserted manually to the switching member 40 which is at the abutting position. When the leading end of paper abuts the switching member 40, a distance "a" from the position of the leading end of paper to the edge sensor 80 is constant. Next, as shown in FIG. 15B, by rotating inversely the conveyance roller 34, the cut paper 11 enters the manual feeding conveyance path which is formed by guide members 251, 252. Then, the conveyance roller 34 is rotated until a paper ejection sensor as a photo sensor or the edge sensor 80 detects the back end of paper. According to the above-described configuration, a conveyance amount "X" of the cut paper 11 from FIG. 15A to the state shown in FIG. 15B is obtained. Therefore, the length of paper can be detected from a sum of the conveyance amount "X" and the distance "a". Then, a problem of breaking of printing halfway or the like is solved.

Figure 16:
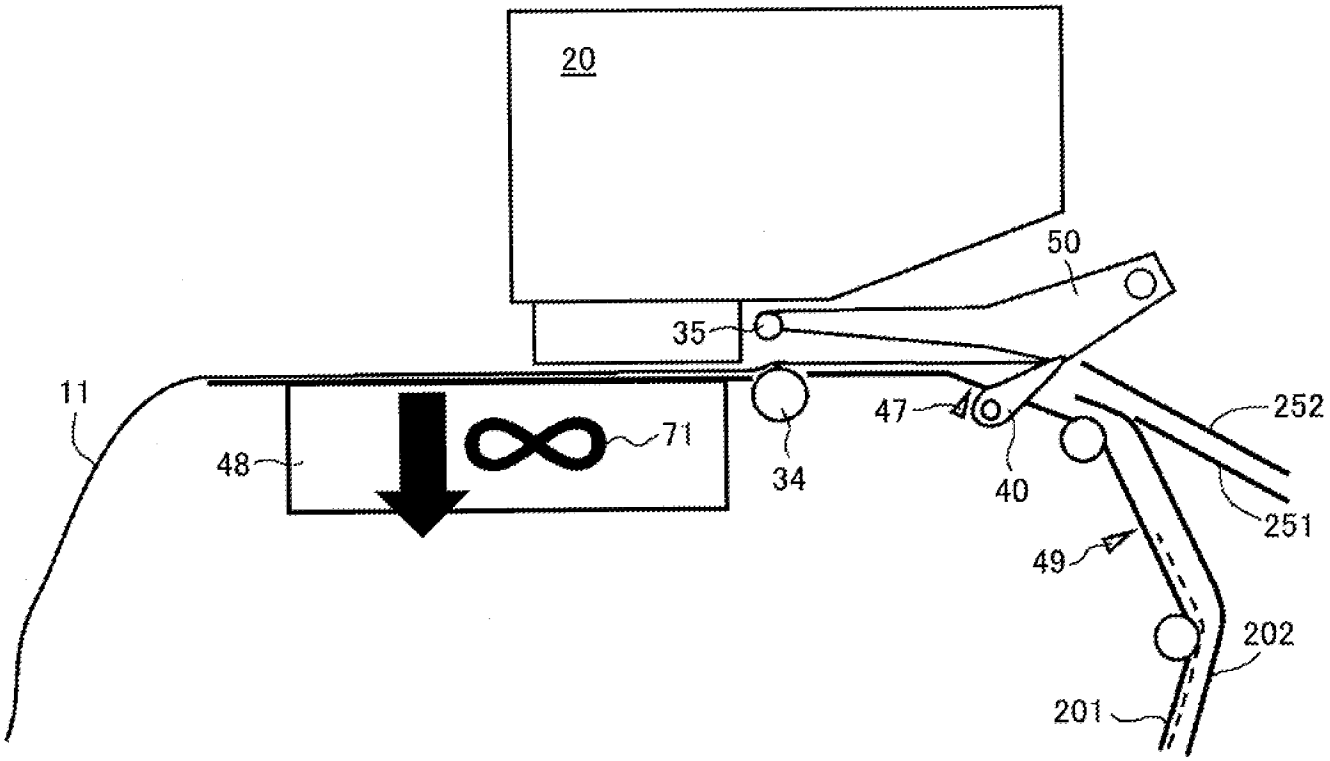
FIG. 16 is a side view schematically illustrating yet another example of the configuration around the carriage 20 according to the present embodiment.

FIG. 16 is a side view schematically illustrating yet another example of the configuration around the carriage 20.

A platen 48 provided with a fan 71 inside thereof as a suction means is arranged facing the carriage 20 across the paper conveyance path. A manual feeding sensor 47 detects the cut paper 11 abutting the switching member 40 by the manual paper feeding. When the cut paper 11 is detected, the platen 48 starts suction with rotation of the fan 71, and the cut paper 11 can be held there. In a case of performing pressing manually by the pressure roller 35 using the pressure arm 50 or a lever connected to the pressure arm 50, an operation for the pressure arm or the lever is required to be performed while holding the cut paper 11 by one hand, and it is difficult to operate. According to the present embodiment, since the cut paper 11 is suctioned after abutting the switching member 40, the cut paper 11 stays on the platen 48 without holding it by hand, and the operation becomes easier.

Figure 17A:
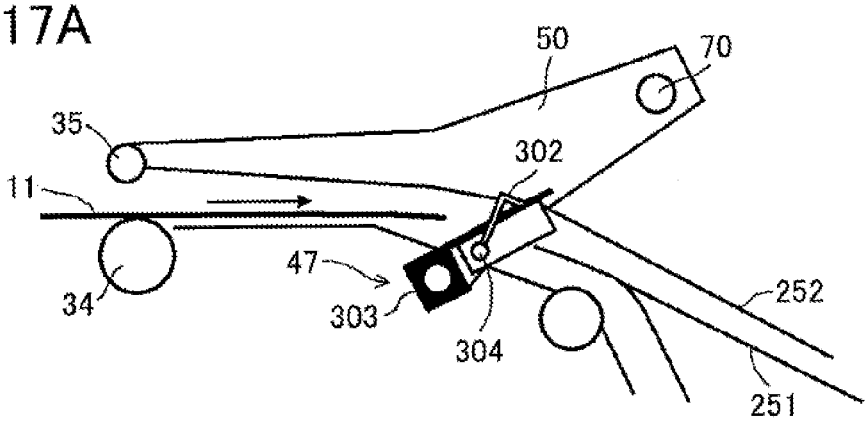
FIGS. 17A to 17C are side views schematically illustrating yet another example of the status of the cut paper 11 and the switching member 40 upon manually feeding paper according to the present embodiment.
Figure 17B:
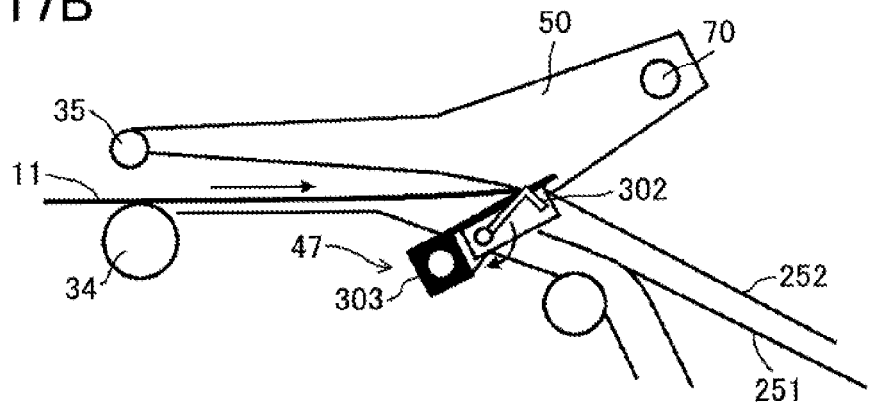
Figure 17C:
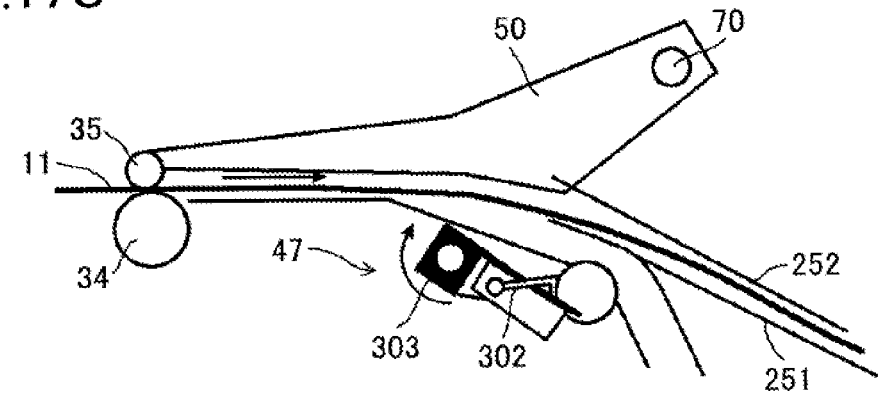

FIGS. 17A to 17C are side views schematically illustrating yet another example of the status of the cut paper 11 and the switching member 40 upon manually feeding paper.

In the present embodiment, a manual feeding sensor 47 for detecting the cut paper 11 abutting the switching member 40 is a filler type sensor. The manual feeding sensor 47 is arranged below the paper conveyance path coaxially with the switching member 40, and with the rotation of the axle 41 moves to the retracted position along with the switching member 40.

The filler type sensor includes a fixation unit 303 fixed to the axle 41 and a filler 302 arranged rotatably in a main body. In a case of using a general-purpose filler type sensor for the filler type sensor, the filler moves smoothly only in one direction and a paper passing in an opposite direction tends to be caught. The sensor for detecting a cut paper fed manually, which is arranged between the abutting position and the conveyance roller, becomes an obstruction upon conveying roll paper.

According to the present embodiment, as shown in FIG. 17A, a cut paper 11 is inserted manually to the switching member 40 which is at the abutting position in a state where the pressure roller 35 is decompressed by a rotation of the pressure arm 50, the clamping with the conveyance roller 34 is released. Then, as shown in FIG. 17B, the cut paper 11 contacts the filler 302 of the filler type sensor, and the filler 302 rotates clockwise in the drawing around an axle 304. According to the above-described operation, the cut paper 11 abutting the switching member 40 is detected. Next, as shown in FIG. 17C, in a case of pressing the pressure roller 35, and sending the cut paper 11 to the manual feeding conveyance path by the conveyance roller 34 and the pressure roller 35, with rotation of the conveyance roller 34, the filler type sensor moves to the retracted position along with the switching member 40, and thereby the above-described problem is solved.

Figure 18:
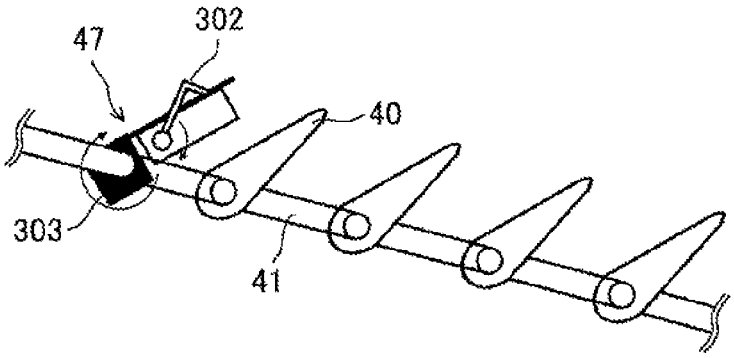
FIG. 18 is a perspective view schematically illustrating an example of a filler type sensor and the switching member 40 according to the present embodiment.

FIG. 18 is a perspective view schematically illustrating a filler type sensor and the switching member 40. The filler type sensor is fixed to the axle 41 in the same way as the switching member 40. Therefore, when the cut paper 11 contacts the filler 302 and rotates it, the cut paper abuts the switching member 40 which is at the abutting position. Moreover, the filler type sensor rotates with the switching member 40 with the rotation of the axle 41. Since the filler type sensor is not a reflection type sensor but a transmission type sensor, a cost is low.

Figure 19A:
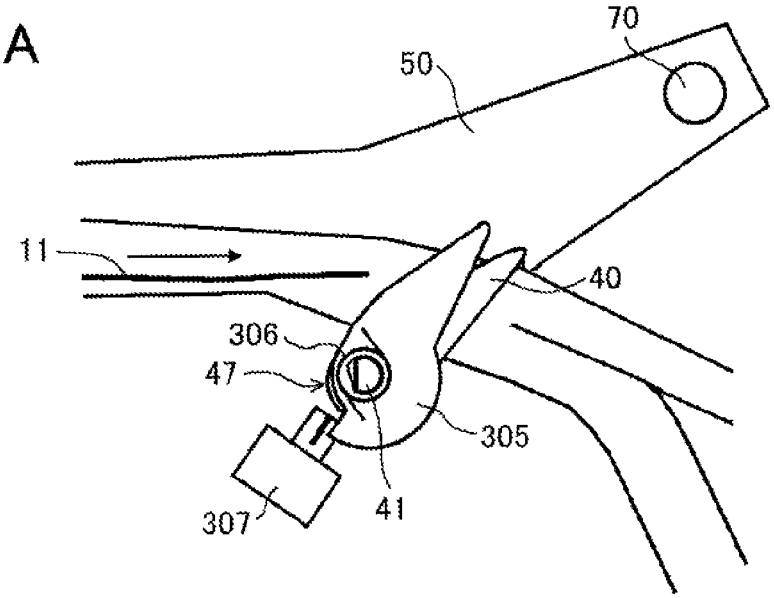
FIGS. 19A and 19B are side views schematically illustrating yet another example of the status of the cut paper 11 and the switching member 40 upon manually feeding paper according to the present embodiment.
Figure 19B:
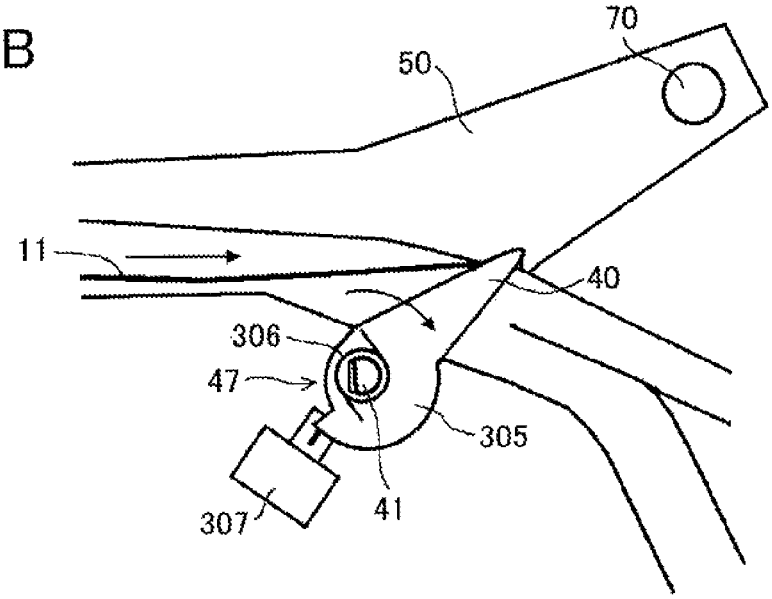

FIGS. 19A and 19B are side views schematically illustrating yet another example of the status of the cut paper 11 and the switching member 40 upon manually feeding paper.

In the present embodiment, a manual feeding sensor 47 for detecting the cut paper 11 abutting the switching member 40 is not a general-purpose filler type sensor, but a filler type sensor having a shape similar to the switching member 40. Specifically, the manual feeding sensor 47 includes a filler shape part 305 attached rotatably to the axle 41, a torsion coil spring 306 for urging the filler shape part 305 in a counterclockwise direction in the drawing, and a transmission type photo sensor 307. As shown in FIG. 19A, in a case where the cut paper 11 does not abut the filler shape part 305, according to a pressing force by the torsion coil spring 306, the filler shape part 305 is positioned in front of the switching member 40. In a case where the cut paper 11 abuts the filler shape part 305 by being inserted manually, as shown in FIG. 19B, the filler shape part 305 rotates, and the transmission type photo sensor 307 detects the filler shape part 305 rotating. Therefore, the cut paper 11 abutting the switching member 40 is detected.

Further, the present invention is not limited to these embodiments, but various variations and modifications may be made without departing from the scope of the present invention.

The present application is based on and claims the benefit of priority of Japanese Priority Applications No. 2014-224118 filed on Nov. 4, 2014 and No. 2015-055931 filed on Mar. 19, 2015, the entire contents of which are hereby incorporated by reference.

What is claimed is:

1. An image forming apparatus comprising:

a paper feeding unit configured to store and feed a recording medium;

an image formation unit configured to form an image on the recording medium;

a conveyance unit configured to clamp and convey the recording medium fed from the paper feeding unit along a conveyance path to the image formation unit;

a driving source configured to supply a driving force to the conveyance unit;

a paper ejection and feeding unit configured to (a) eject the recording medium and (b) receive an other recording medium that is manually inserted into the paper ejection and feeding unit; and a switching member having a claw and fixed on an axle and configured to move between a retracted position in which the switching member is retracted from the conveyance path and an abutting position in which the switching member abuts a leading end of said other recording medium to prevent bending in said other recording medium, wherein when said other recording medium is manually inserted into the paper ejection and feeding unit, (i) the conveyance unit releases the clamping of the recording medium, (ii) the switching member moves to the abutting position, (iii) the conveyance unit clamps the other recording medium when the leading end of said other recording medium abuts the switch member, and (iv) the switching member moves to the retracted position when the image formation unit forms an image on the recording medium or the other recording medium.

2. The image forming apparatus as claimed in claim 1, wherein a back end of the other recording medium is detected by a photo sensor while the other recording medium is conveyed from the abutment position to a print start position, and a length of the other recording medium is automatically detected.

3. The image forming apparatus as claimed in claim 1, wherein when a manual feeding sensor detects the other recording medium butting against the switching member, the other recording medium is held there by a suction unit.

4. The image forming apparatus as claimed in claim 3, wherein the manual feeding sensor is a filler type sensor, which moves to the retracted position along with the switching member.

5. An image forming apparatus comprising:

a paper feeding unit configured to store and feed a recording medium;

an image formation unit configured to form an image on the recording medium;

a conveyance unit configured to clamp and convey the recording medium fed from the paper feeding unit along a conveyance path to the image formation unit;

a driving source configured to supply a driving force to the conveyance unit;

a paper ejection unit configured to eject the recording medium;

a manual paper feeding unit configured to receive another recording medium inserted manually and feed the other recording medium from the paper ejection unit; and a switching member having a claw and fixed on an axle and configured to move between a retracted position retracted from the conveyance path and an abutting position entering the conveyance path by rotating with a rotation of the axle, wherein when the another recording medium is manually inserted into the manual paper feeding unit, the switching member is arranged at the abutting position, clamping of the recording medium by the conveyance unit is released, the other recording medium fed by the manual paper feeding unit from the paper ejection unit arrives at an abutment position where a leading end of the other recording medium abuts the switching member, and the conveyance unit clamps the other recording medium, and the switching member is arranged at the retracted position when the image formation unit forms an image on the recording medium or the other recording medium, wherein the switching member is arranged at a switching position for guiding the other recording medium to a manual feeding conveyance path when the conveyance unit clamps and conveys the other recording medium.

6. The image forming apparatus as claimed in claim 5, wherein switching among the abutting position, the switching position and the retracted position of the switching member is performed by rotating the axle on which the switching member is fixed, and the axle is rotated by the driving force supplied from the driving source.

7. The image forming apparatus as claimed in claim 5, wherein the axle is linked to the conveyance unit via a clutch and a slip rotation unit linked to the clutch, the clutch being linked on a side of the conveyance unit, when engaging the clutch, the axle is configured to be driven by the driving force from the driving source, and when releasing the clutch, according to a rotational load applied by the slip rotation unit, the abutting position, the switching position and the retracted position of the switching member are retained.

8. The image forming apparatus as claimed in claim 7, wherein the slip rotation unit includes a gear, a spring and a circular plate, and is configured to transmit the driving force from the driving source to the axle.

9. The image forming apparatus as claimed in claim 5, further comprising:

a first rotation restricting member for restricting a rotation of the switching member provided on a side plate;

a second rotation restricting member for restricting a rotation of the switching member provided on the axle; and a slip rotation unit in which, when an excessive load is applied, a slip occurs and transmission of torque to the axle is automatically blocked.

10. The image forming apparatus as claimed in claim 9, wherein when the first rotation restricting member abuts the second rotation restricting member, the switching member is positioned at the abutting position or the retracted position, and the switching member is configured to move by rotating using the abutting position or the retracted position as an initial position.

11. The image forming apparatus as claimed in claim 9, wherein the second rotation restricting member is a disk-shaped member having a notch in a part in a circumferential direction.

12. The image forming apparatus as claimed in claim 9, wherein the first rotation restricting member is two screws fixed to the side plate, and the second rotation restricting member is a spring pin fixed to the axle and extending between the two screws.

13. The image forming apparatus as claimed in claim 5, wherein any one of the abutting position, the switching position and the retracted position of the switching member is detected as an initial position by a filler fixed to the axle and a sensor for detecting the filler, and the switching member is configured to move by rotating from the initial position.

14. The image forming apparatus as claimed in claim 5, wherein when inverting a conveyance direction of the conveyance unit to guide the other recording medium to the manual feeding conveyance path, a position at which the switching member is arranged is switched to the abutting position, the switching position and the retracted position in this order, and a moving speed of a part of the switching member, which abuts the leading end of the other recording medium, the switching member being at the abutting position, is greater than a conveyance speed of the other recording medium by the conveyance unit.

15. The image forming apparatus as claimed in claim 5, wherein while the switching member moves from the abutting position to the switching position, the leading end of the other recording medium enters the manual feeding conveyance path.

* * * * *